US010545451B2

(12) United States Patent
Fujii et al.

(10) Patent No.: US 10,545,451 B2
(45) Date of Patent: Jan. 28, 2020

(54) IMAGE FORMING APPARATUS INCLUDING SWING PLATE CONFIGURED TO SUPPORT DEVELOPING CARTRIDGE

(71) Applicant: Brother Kogyo Kabushiki Kaisha, Nagoya-shi, Aichi-ken (JP)

(72) Inventors: Yasumasa Fujii, Anjo (JP); Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/052,127

(22) Filed: Aug. 1, 2018

(65) Prior Publication Data

US 2019/0079447 A1 Mar. 14, 2019

(30) Foreign Application Priority Data

Sep. 11, 2017 (JP) ..... 2017-173675

(51) Int. Cl.
*G03G 21/18* (2006.01)
*G03G 21/16* (2006.01)

(52) U.S. Cl.
CPC ..... *G03G 21/1676* (2013.01); *G03G 21/1671* (2013.01); *G03G 21/1814* (2013.01); *G03G 21/1821* (2013.01); *G03G 21/1842* (2013.01); *G03G 21/1853* (2013.01);
(Continued)

(58) Field of Classification Search
CPC ..... G03G 21/1676; G03G 21/1814; G03G 21/1842; G03G 2221/183; G03G 2221/163; G03G 2221/1654; G03G 21/1671; G03G 21/1821; G03G 21/1853; G03G 15/0147
See application file for complete search history.

(56) References Cited

U.S. PATENT DOCUMENTS 6,907,209 B2 * 6/2005 Abe ..... G03G 15/1605 399/107
9,256,196 B2 2/2016 Sato et al.
9,280,132 B2 3/2016 Nishiyama et al.
(Continued)

FOREIGN PATENT DOCUMENTS

JP H07-234552 A 9/1995
JP 2015-175934 A 10/2015
JP 2015-197504 A 11/2015

*Primary Examiner* — David M. Gray
*Assistant Examiner* — Laura Roth
(74) *Attorney, Agent, or Firm* — Banner & Witcoff, Ltd.

(57) ABSTRACT

An apparatus main body includes a main casing and a cover configured to rotatably move about a rotational axis located below an opening between an open position and a closed position. A drum cartridge includes a photosensitive drum and is configured to be installed into the apparatus main body through the opening. A developing cartridge includes a developing roller and is configured to be installed into the apparatus main body through the opening. A swing plate is attached swingably to the apparatus main body. The swing plate supports the developing cartridge. The swing plate includes a guide configured to guide installation of the developing cartridge into the apparatus main body. The swing plate is configured to swingably move in a state where the drum cartridge and the developing cartridge are installed in the apparatus main body, thereby causing the developing roller to move relative to the photosensitive drum.

18 Claims, 13 Drawing Sheets

(52) U.S. Cl.
CPC ..... *G03G 2221/163* (2013.01); *G03G 2221/1654* (2013.01); *G03G 2221/183* (2013.01)

(56) References Cited

U.S. PATENT DOCUMENTS

| | | | | |
|---|---|---|---|---|
| 9,513,596 | B2 | 12/2016 | Sato et al. | |
| 2004/0190932 | A1* | 9/2004 | Ishii | G03G 21/1853 399/110 |
| 2005/0053394 | A1* | 3/2005 | Ishii | G03G 21/1821 399/111 |
| 2008/0286003 | A1* | 11/2008 | Fukuda | G03G 21/1647 399/119 |
| 2011/0305480 | A1* | 12/2011 | Tanaami | G03G 15/0147 399/112 |
| 2015/0261179 | A1 | 9/2015 | Sato et al. | |
| 2015/0277368 | A1 | 10/2015 | Nishiyama et al. | |
| 2016/0154372 | A1 | 6/2016 | Sato et al. | |
| 2016/0187837 | A1 | 6/2016 | Nishiyama et al. | |
| 2016/0231698 | A1* | 8/2016 | Miyoshi | G03G 21/1842 |
| 2017/0261927 | A1* | 9/2017 | Sato | G03G 21/1817 |
| 2018/0024494 | A1* | 1/2018 | Shibuya | G03G 21/185 399/119 |
| 2018/0321637 | A1* | 11/2018 | Sato | G03G 21/1619 |
| 2019/0079447 | A1* | 3/2019 | Fujii | G03G 21/1676 |
| 2019/0079449 | A1* | 3/2019 | Fujii | G03G 21/1842 |

* cited by examiner

IMAGE FORMING APPARATUS INCLUDING SWING PLATE CONFIGURED TO SUPPORT DEVELOPING CARTRIDGE

CROSS REFERENCE TO RELATED APPLICATIONS

This application claims priority from Japanese Patent Application No. 2017-173675 filed Sep. 11, 2017. The entire content of the priority application is incorporated herein by reference.

TECHNICAL FIELD

This disclosure relates to an image forming apparatus.

BACKGROUND

An image forming apparatus is conventionally known. The image forming apparatus includes an apparatus main body, a drum cartridge configured to be installed in the apparatus main body, and a developing cartridge configured to be installed in the apparatus main body.

The drum cartridge includes a photosensitive drum. The developing cartridge includes a developing roller. In a state where the drum cartridge and the developing cartridge are installed in the apparatus main body, the developing roller contacts the photosensitive drum.

SUMMARY

According to one aspect, this specification discloses an image forming apparatus. The image forming apparatus includes an apparatus main body, a drum cartridge, a developing cartridge, and a swing plate. The apparatus main body includes: a main casing having an opening, the opening being formed at a side of the main casing; and a cover configured to rotatably move about a rotational axis between an open position at which the opening is opened and a closed position at which the opening is closed, the rotational axis being located below the opening. The drum cartridge includes a photosensitive drum and is configured to be installed into the apparatus main body through the opening. The developing cartridge includes a developing roller and is configured to be installed into the apparatus main body through the opening. The swing plate is attached swingably to the apparatus main body. The swing plate is configured to support the developing cartridge. The swing plate includes a guide configured to guide installation of the developing cartridge into the apparatus main body. The swing plate is configured to swingably move in a state where the drum cartridge and the developing cartridge are installed in the apparatus main body, thereby causing the developing roller to move relative to the photosensitive drum.

BRIEF DESCRIPTION OF THE DRAWINGS

Embodiments in accordance with this disclosure will be described in detail with reference to the following figures wherein.

DETAILED DESCRIPTION

In the above-described image forming apparatus, it is desired that the developing roller is configured to move relative to the photosensitive drum in a state where the drum cartridge and the developing cartridge are installed, and the developing roller is pressed toward the photosensitive drum, thereby suitably maintaining the positional relationship between the photosensitive drum and the developing roller.

An example of an object of this disclosure is to provide an image forming apparatus that the developing roller is configured to move relative to the photosensitive drum in a state where the drum cartridge and the developing cartridge are installed in the apparatus main body, and the developing roller is pressed toward the photosensitive drum, thereby suitably maintaining the positional relationship between the photosensitive drum and the developing roller.

1. Overview of Image Forming Apparatus 1

Figure 1A:
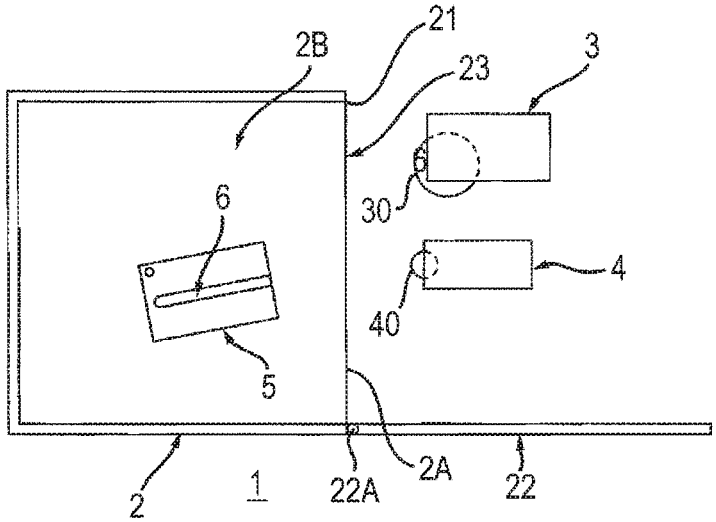
FIG. 1A is a schematic diagram showing an image forming apparatus of this disclosure, and shows a state before a drum cartridge and a developing cartridge are installed into an apparatus main body.
Figure 1B:
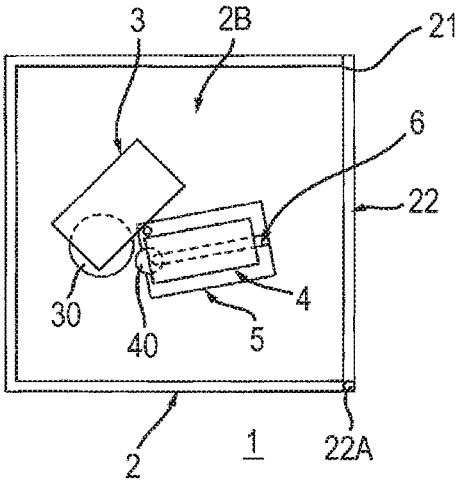
FIG. 1B shows a state where the drum cartridge and the developing cartridge are installed in the apparatus main body, continuing from FIG. 1A.
Figure 1C:
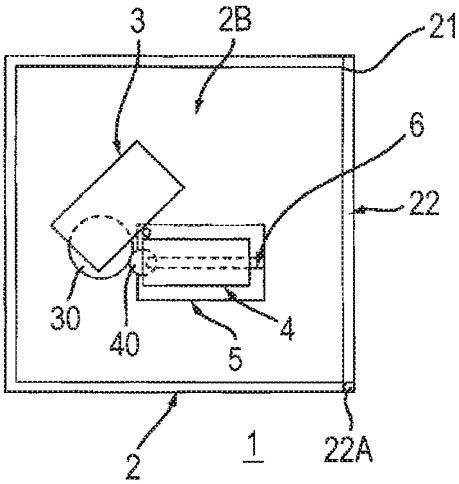
FIG. 1C shows a state where a swing plate is swingably moved, continuing from FIG. 1B.

The overview of an image forming apparatus 1 will be described while referring to FIG. 1A to FIG. 1C.

The image forming apparatus 1 includes an apparatus main body 2, a drum cartridge 3, a developing cartridge 4, and a swing plate 5.

1.1 Apparatus Main Body 2.

The apparatus main body 2 is formed with an opening 21 and an internal space 2B in communication with the opening 21. The opening 21 is provided at a side surface 2A of the apparatus main body 2. The opening 2A is commonly used both when the drum cartridge 3 is installed into the apparatus main body 2 and when the developing cartridge 4 is installed into the apparatus main body 2. The internal space 2B is configured to accommodate the drum cartridge 3 and the developing cartridge 4.

The apparatus main body 2 includes a side wall 23 and a cover 22. The opening 21 is formed in the side wall 23. The side wall 23 has the side surface 2A. The cover 22 is a front cover provided at the side wall 23. The cover 22 is configured to rotatably move about a rotational shaft 22A between an open position at which the opening 21 is opened and a closed position at which the opening 21 is closed. The cover 22 includes the rotational shaft 22A. The rotational shaft 22A is rotatably supported at the side wall 23. The rotational shaft 22A of the cover 22 is disposed at a lower position than the opening 21. In other words, the cover 22 is configured to rotatably move about the rotational shaft 22A located below the opening 21 between the open position at which the opening 21 is opened and the closed position at which the opening 21 is closed.

1.2 Drum Cartridge 3

The drum cartridge 3 is configured to be installed into the apparatus main body 2 through the opening 21. When the drum cartridge 3 is installed into the apparatus main body 2, the drum cartridge 3 is accommodated into the internal space 2B through the opening 21. In a state where the drum cartridge 3 is installed in the apparatus main body 2, the drum cartridge 3 is supported by the apparatus main body 2, not by the swing plate 5. The drum cartridge 3 includes a photosensitive drum 30.

1.3 Developing Cartridge 4

The developing cartridge 4 is configured to be installed into the apparatus main body 2 through the opening 21. When the developing cartridge 4 is installed into the apparatus main body 2, the developing cartridge 4 is accommodated into the internal space 2B through the opening 21. In a state where the developing cartridge 4 is installed in the apparatus main body 2, the developing cartridge 4 is supported by the swing plate 5. In a state where the drum cartridge 3 and the developing cartridge 4 are installed in the apparatus main body 2, the developing cartridge 4 is located between the photosensitive drum 30 and the cover 22 located at the closed position. The developing cartridge 4 includes a developing roller 40.

1.4 Swing Plate 5

The swing plate 5 is configured to support the developing cartridge 4. The swing plate 5 has a guide 6. The guide 6 is a developing guide for guiding installation of the developing cartridge 4 into the apparatus main body 2. The swing plate 5 supports the developing cartridge 4 that is guided by the guide 6 and installed in the apparatus main body 2. The guide 6 extends in the installation direction of the developing cartridge 4. The installation direction of the developing cartridge 4 is a direction in which the developing cartridge 4 is guided by the guide 6 when the developing cartridge 4 is installed into the apparatus main body 2. The swing plate 5 is swingably attached to the apparatus main body 2. In a state where the drum cartridge 3 and the developing cartridge 4 are installed in the apparatus main body 2, the swing plate 5 swingably moves and thereby causes the developing roller 40 to move relative to the photosensitive drum 30.

2. First Embodiment

An image forming apparatus 10 according to a first embodiment will be described while referring to FIG. 2 to FIG. 7. In the image forming apparatus 10 of the first embodiment, parts and components similar to those described in the overview of the above-described image forming apparatus 1 are designated by the same reference numerals to avoid duplicating description.

Figure 2:
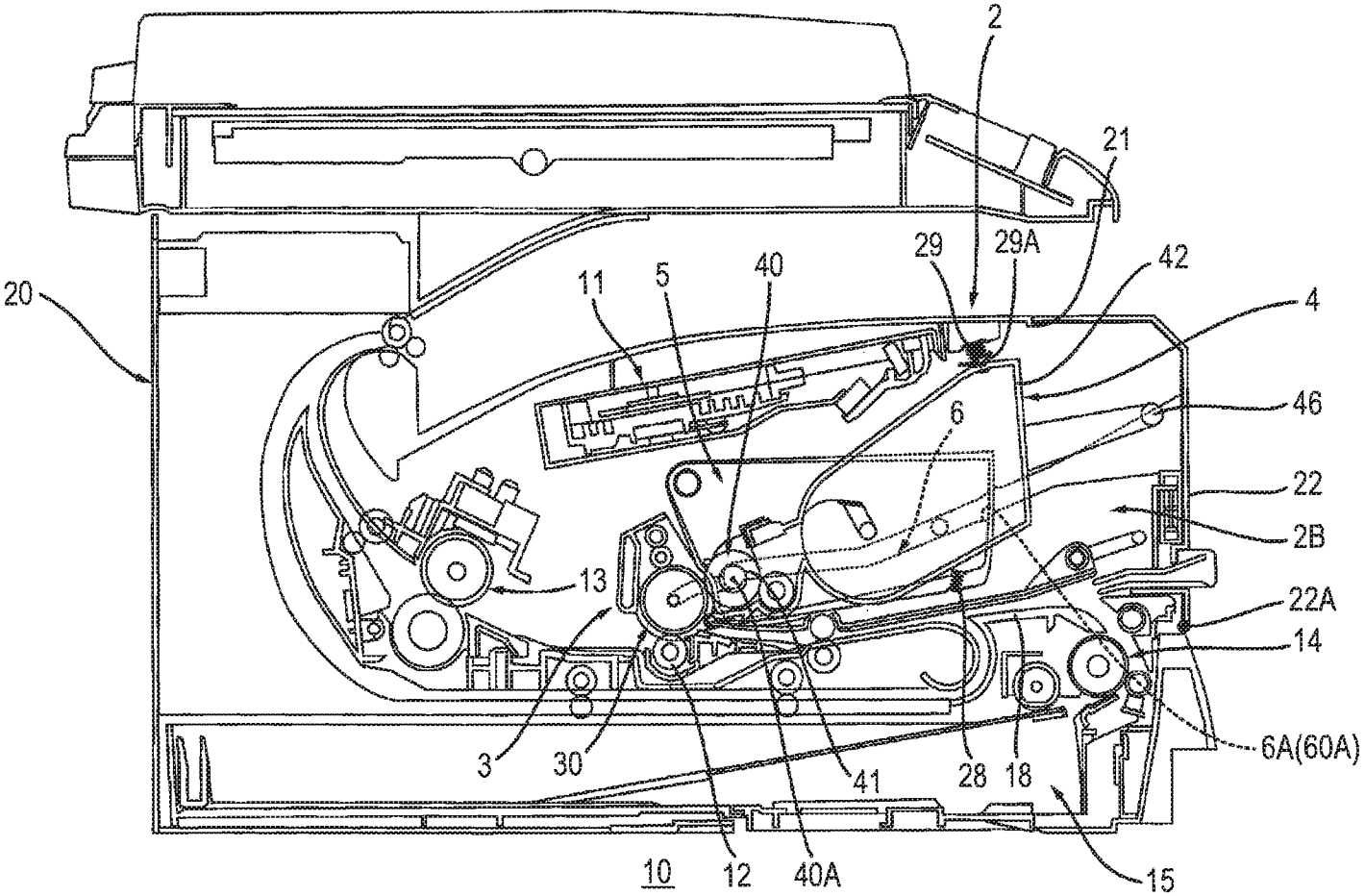
FIG. 2 is a cross-sectional view of an image forming apparatus according to a first embodiment, and shows a state where the swing plate is located at a second position.
Figure 4:
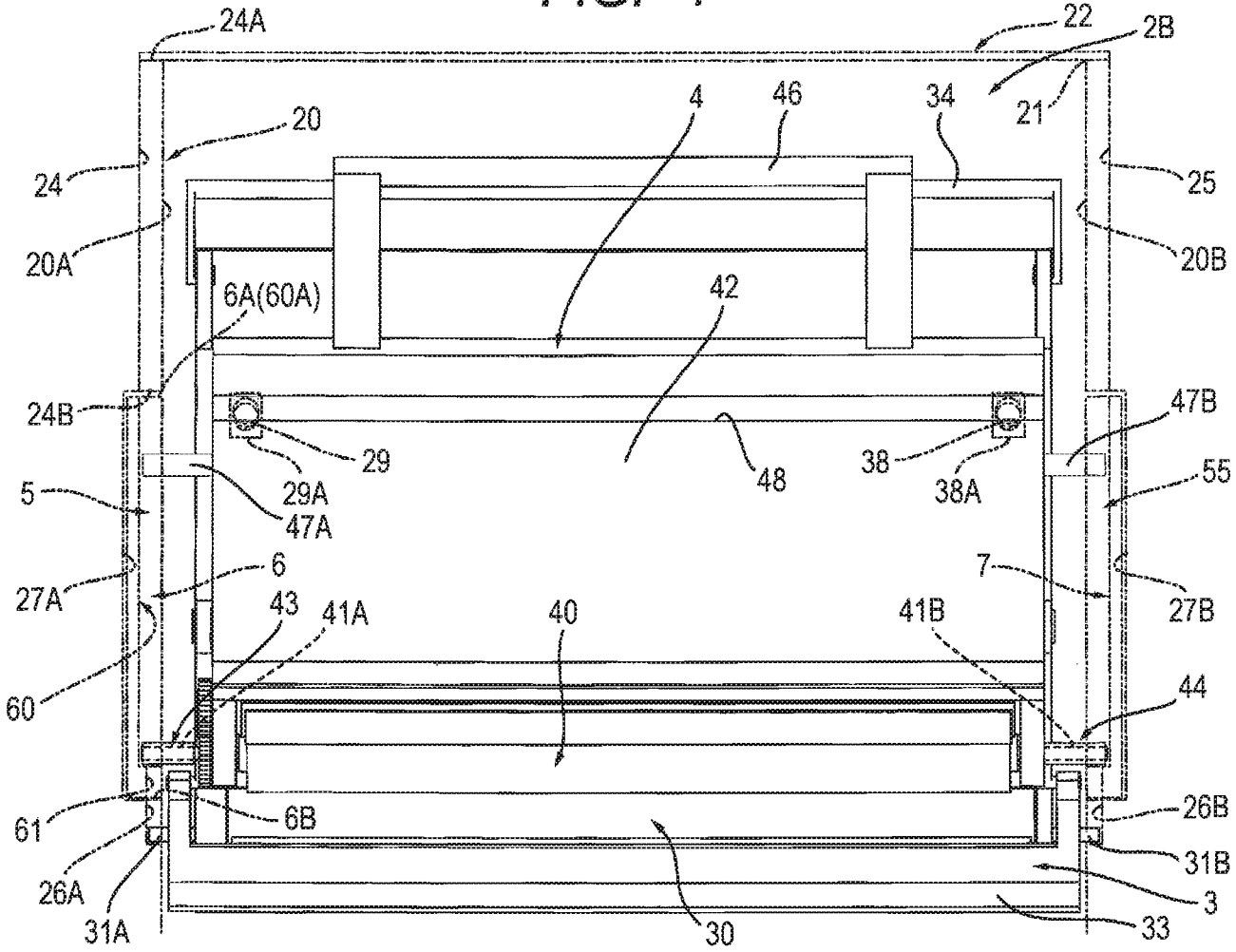
FIG. 4 is a plan view showing a state where the drum cartridge and developing cartridge are installed in the apparatus main body shown in FIG. 3.

As shown in FIG. 2, the image forming apparatus 10 includes the apparatus main body 2, the drum cartridge 3, the developing cartridge 4, the swing plate 5, a second swing plate 55 (see FIG. 4).

The apparatus main body 2 includes a main casing 20, a laser scan unit 11, a transfer roller 12, a fixing device 13, a paper feed tray 15, and a paper feeder 14.

The main casing 20 includes the opening 21 and the cover 22. The main casing 20 accommodates the laser scan unit 11, the transfer roller 12, the fixing device 13, the paper feed tray 15, and the paper feeder 14. Inside the main casing 20, the internal space 2B is located between the fixing device 13 and the cover 22 located at the closed position, and is located between the laser scan unit 11 and the transfer roller 12.

The laser scan unit 11 is configured to expose the photosensitive drum 30 to light. The transfer roller 12 is configured to transfer a toner image formed on a surface of the photosensitive drum 30 onto paper. The transfer roller 12 contacts the surface of the photosensitive drum 30 in a state where the drum cartridge 3 is installed in the apparatus main body 2. The fixing device 13 is configured to heat and apply pressure to paper on which a toner image is transferred, thereby fixing the toner image on the paper. The paper feed tray 15 is configured to accommodate paper.

The paper feeder 14 is configured to supply paper in the paper feed tray 15 to between the photosensitive drum 30 and the transfer roller 12. The paper feeder 14 includes a conveyance guide 18. The conveyance guide 18 guides paper sent from the paper feed tray 15 toward between the photosensitive drum 30 and the transfer roller 12.

2.1 Detail of Drum Cartridge 3

Figure 3:
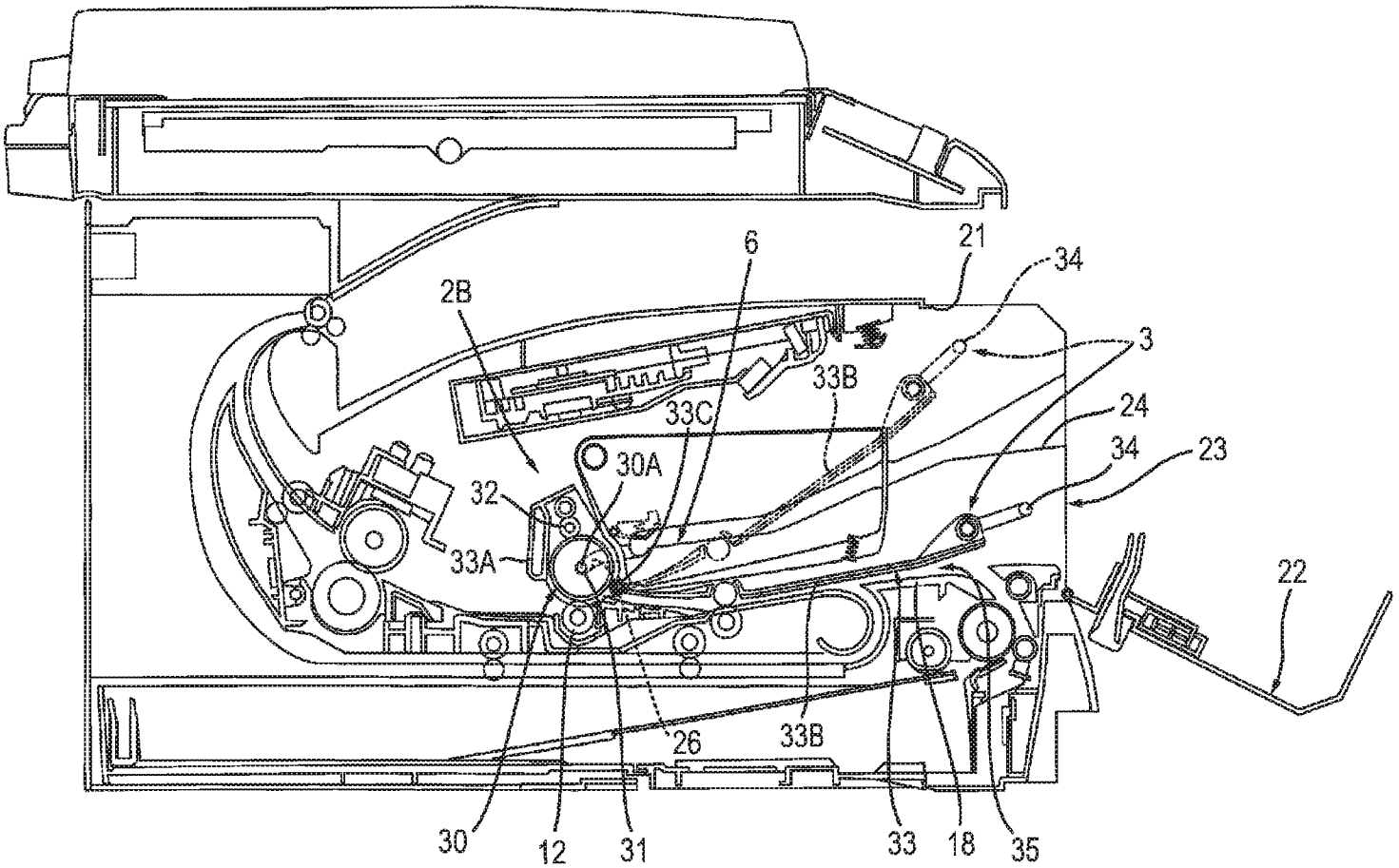
FIG. 3 is a cross-sectional view of an apparatus main body shown in FIG. 2, and shows a state where a drum cartridge is installed in the apparatus main body.

As shown in FIG. 3, the drum cartridge 3 includes a drum frame 33, the photosensitive drum 30, a charging roller 32, and a drum handle 34.

The drum frame 33 supports the photosensitive drum 30, the charging roller 32, and the drum handle 34. The drum frame 33 includes a main frame 33A and an extending portion 33B. The main frame 33A supports the photosensitive drum 30 and the charging roller 32. The extending portion 33B extends from the main frame 33A in a direction intersecting the upper-lower direction. The drum frame 33 has one end and another end in the direction in which the drum frame 33 extends. The photosensitive drum 30 and the charging roller 32 are arranged at the main frame 33A located at the one end of the drum frame 33. The drum handle 34 is arranged at the extending portion 33B extending toward the other end of the drum frame 33. In a state where the drum cartridge 3 is installed in the apparatus main body 2, the drum frame 33 is located above the conveyance guide 18 with an interval therebetween. In a state where the drum cartridge 3 is installed in the apparatus main body 2, the extending portion 33B of the drum frame 33 and the conveyance guide 18 form a conveyance path 35. The conveyance path 35 allows passage of paper conveyed toward between the photosensitive drum 30 and the transfer roller 12.

The photosensitive drum 30 is so configured that a toner image is formed on the surface thereof. The photosensitive drum 30 is configured to rotate about a rotational axis 30A extending in the axial direction. The axial direction intersects the upper-lower direction and the installation direction of the developing cartridge 4. Preferably, the axial direction is perpendicular to both the upper-lower direction and the installation direction of the developing cartridge 4. The photosensitive drum 30 includes a drum shaft 31 extending along the rotational axis 30A of the photosensitive drum 30.

The charging roller 32 is configured to charge the surface of the photosensitive drum 30. The charging roller 32 contacts the surface of the photosensitive drum 30.

The drum handle 34 is configured to be gripped by a user when the drum cartridge 3 is installed into the apparatus main body 2 or when the drum cartridge 3 is removed from the apparatus main body 2. The drum handle 34 extends from the other end of the drum frame 33. When paper is jammed in the conveyance path 35, the drum handle 34 is gripped and pulled up by the user. Then, as indicated by the double-dot chain lines in FIG. 3, the extending portion 33B rotatably moves about a rotational axis 33C relative to the main frame 33A in a state where the drum cartridge 3 is not removed from the apparatus main body 2. With this configuration, the conveyance path 35 is opened and the user can easily remove the paper jammed in the conveyance path 35.

2.2 Detail of Developing Cartridge 4

As shown in FIG. 2, the developing cartridge 4 includes a frame 42, the developing roller 40, and a developing handle 46.

The frame 42 accommodates toner. The frame 42 supports the developing roller 40 and the developing handle 46.

The developing roller 40 is configured to supply toner to the photosensitive drum 30. In a state where the drum cartridge 3 and the developing cartridge 4 are installed in the apparatus main body 2, the developing roller 40 contacts or is adjacent to the surface of the photosensitive drum 30. The developing roller 40 is configured to rotate about a rotational axis 40A extending in the axial direction. The developing roller 40 includes a developing shaft 41 extending along the rotational axis 40A of the developing roller 40. The developing handle 46 is configured to be gripped by the user when the developing cartridge 4 is installed into the apparatus main body 2 or when the developing cartridge 4 is removed from the apparatus main body 2. In a state where the drum cartridge 3 and the developing cartridge 4 are installed in the apparatus main body 2, the developing handle 46 is located at the opposite side from the photosensitive drum 30 with respect to the frame 42. The developing handle 46 extends from the frame 42.

As shown in FIG. 4, the developing cartridge 4 includes a protrusion 43, a first boss 47A, a second protrusion 44, and a second boss 47B. The protrusion 43 and the first boss 47A are located at one end side with respect to the frame 42 in the axial direction. The second protrusion 44 and the second boss 47B are located at the other end side with respect to the frame 42 in the axial direction.

The protrusion 43 protrudes from the frame 42. The protrusion 43 has a columnar shape. The protrusion 43 includes a part of the developing shaft 41. The developing shaft 41 has one end portion 41A and another end portion 41B in the axial direction. Specifically, the protrusion 43 includes the one end portion 41A of the developing shaft 41. The first boss 47A protrudes from the frame 42. The first boss 47A has a columnar shape. The first boss 47A is located at the upstream side of the protrusion 43 in the installation direction of the developing cartridge 4.

The second protrusion 44 has the same shape as the protrusion 43. The second protrusion 44 includes a part of the developing shaft 41. Specifically, the second protrusion 44 includes the other end portion 41B of the developing shaft 41. The second boss 47B has the same shape as the first boss 47A. The second boss 47B is located at the upstream side of the second protrusion 44 in the installation direction of the developing cartridge 4.

2.3 Detail of Apparatus Main Body 2

As shown in FIG. 4, the apparatus main body 2 includes a first inner side surface 20A, a second inner side surface 20B, a first concave portion 27A, a main body guide 24, a first main body drum guide 26A, a second concave portion 27B, a second main body guide 25, a second main body drum guide 26B, a second pressing spring 28 (see FIG. 2), and a third pressing spring 29 (see FIG. 2). The second pressing spring 28 and the third pressing spring 29 will be described later in "2.4 Detail of swing plate 5".

2.3.1 First Inner Side Surface 20A and Second Inner Side Surface 20B

The first inner side surface 20A and the second inner side surface 20B are inner surfaces of the main casing 20. In a state where the drum cartridge 3 is installed in the apparatus main body 2, the first inner side surface 20A is located at the opposite side from the second inner side surface 20B with respect to the drum cartridge 3. The internal space 2B is located between the first inner side surface 20A and the second inner side surface 20B in the axial direction. The first concave portion 27A, the main body guide 24, and the first main body drum guide 26A are located at the first inner side surface 20A. The second concave portion 27B, the second main body guide 25, and the second main body drum guide 26B are located at the second inner side surface 20B.

Figure 5:
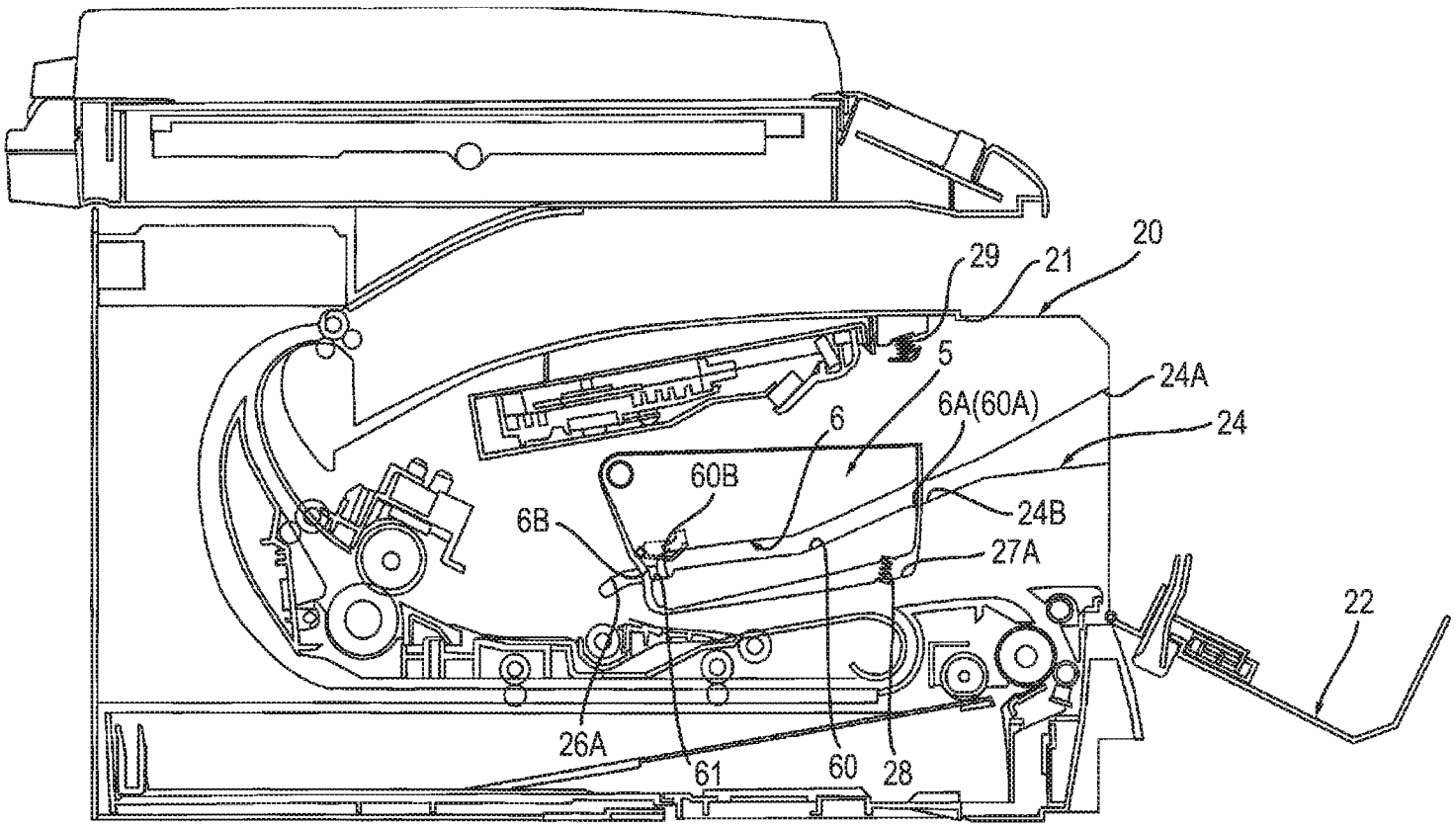
FIG. 5 is a cross-sectional view of the apparatus main body shown in FIG. 2.

2.3.2 First Concave Portion 27A, Main Body Guide 24, and First Main Body Drum Guide 26A As shown in FIG. 4 and FIG. 5, the first concave portion 27A accommodates the swing plate 5. The main body guide 24 guides installation of the developing cartridge 4 and the drum cartridge 3 into the apparatus main body 2. The main body guide 24 guides the developing cartridge 4 and the drum cartridge 3 toward the swing plate 5. The main body guide 24 is located between the first concave portion 27A and the cover 22 located at the closed position (see FIG. 4). The main body guide 24 is a groove. The main body guide 24 may be a rib. The main body guide 24 extends in the installation direction of the developing cartridge 4. The main body guide 24 has an upstream end 24A and a downstream end 24B in the installation direction of the developing cartridge 4. The upstream end 24A of the main body guide 24 is in communication with the opening 21. The downstream end 24B of the main body guide 24 is in communication with the first concave portion 27A.

The first main body drum guide 26A guides installation of the drum cartridge 3 into the apparatus main body 2. The first main body drum guide 26A guides the drum cartridge 3 having passed the swing plate 5 to the position at which the photosensitive drum 30 contacts the transfer roller 12 (see FIG. 2). The first main body drum guide 26A is located at the opposite side from the main body guide 24 with respect to the first concave portion 27A. The first main body drum guide 26A is a groove. The first main body drum guide 26A may be a rib. The first main body drum guide 26A is in communication with the first concave portion 27A. In a state where the drum cartridge 3 is installed in the apparatus main body 2, the first main body drum guide 26A contacts a part of the drum cartridge 3 (see FIG. 4). Specifically, the part of the drum cartridge 3 is one end portion 31A of the drum shaft 31 in the axial direction. The drum shaft 31 has another end portion 31B located away from the one end portion 31A in the axial direction. The one end portion 31A and the other end portion 31B of the drum shaft 31 protrude from the drum frame 33.

2.3.3 Second Concave Portion 27B, Second Main Body Guide 25, and Second Main Body Drum Guide 26B As shown in FIG. 4, the second concave portion 27B accommodates the second swing plate 55. The second main body guide 25 guides installation of the developing cartridge 4 and the drum cartridge 3 into the apparatus main body 2, in cooperation with the main body guide 24. The second main body guide 25 guides the developing cartridge 4 and the drum cartridge 3 toward the second swing plate 55. The second main body guide 25 is located between the second concave portion 27B and the cover 22 located at the closed position. The second main body guide 25 has the same shape as the main body guide 24. The second main body drum guide 26B guides installation of the drum cartridge 3 into the apparatus main body 2, in cooperation with the first main body drum guide 26A. The second main body drum guide 26B is located at the opposite side from the second main body guide 25 with respect to the second concave portion 27B. The second main body drum guide 26B has the same shape as the first main body drum guide 26A. In a state where the drum cartridge 3 is installed in the apparatus main body 2, the second main body drum guide 26B contacts a part of the drum cartridge 3, specifically, the other end portion 31B of the drum shaft 31.

2.4 Detail of Swing Plate 5

Figure 6:
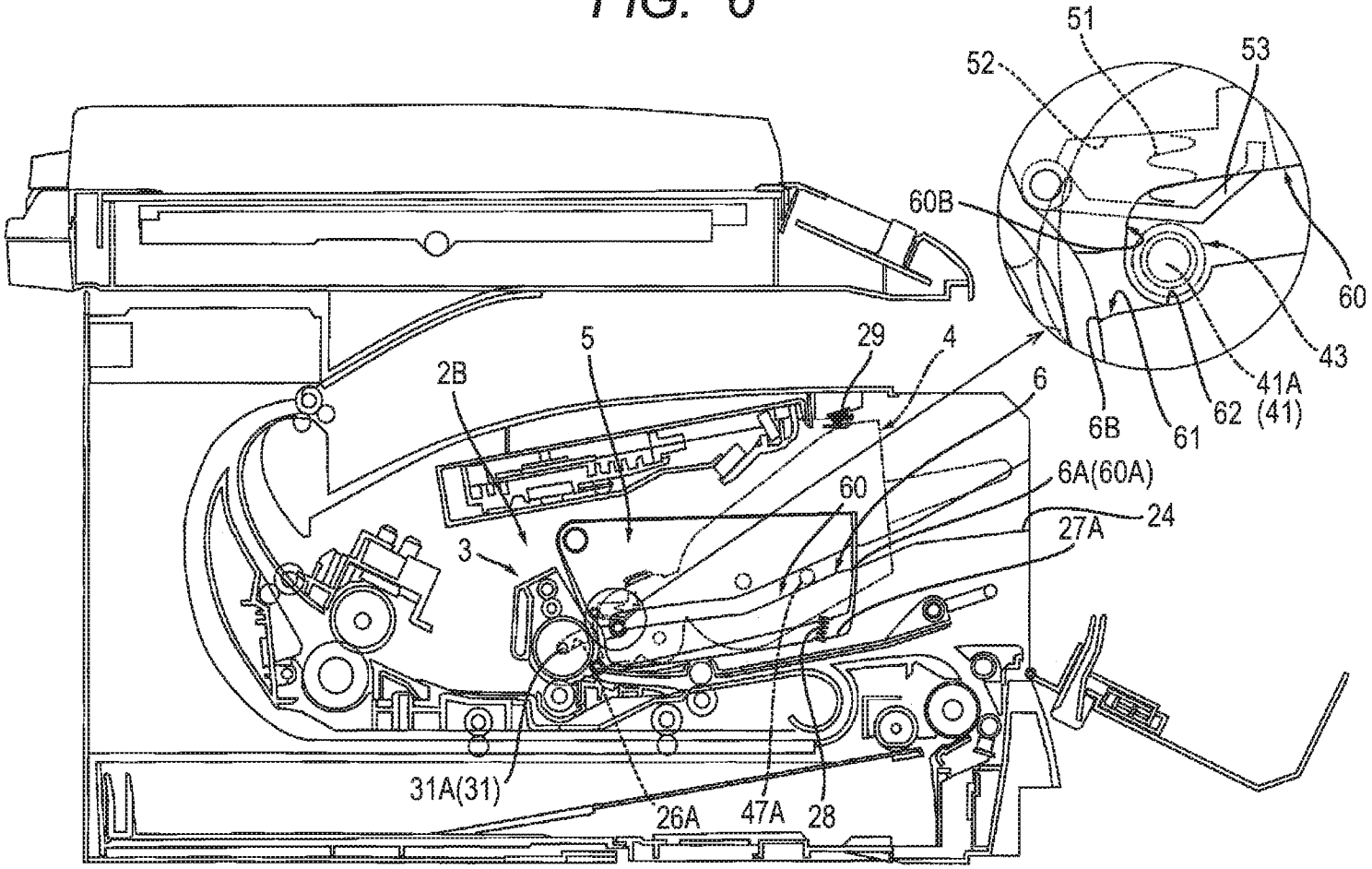
FIG. 6 is a cross-sectional view of the image forming apparatus shown in FIG. 2, and shows a state where the swing plate is located at a first position, wherein the developing cartridge is shown by imaginary lines.

As shown in FIG. 6, the swing plate 5 is arranged inside the first concave portion 27A. The swing plate 5 includes the guide 6 and a first pressing spring 51.

2.4.1 Guide 6

The guide 6 guides installation of the developing cartridge 4 into the apparatus main body 2, and also guides installation of the drum cartridge 3 into the apparatus main body 2. In other words, the guide 6 is a developing guide that guides installation of the developing cartridge 4, and also a drum guide that guides installation of the drum cartridge 3. That is, the developing guide and the drum guide are the common guide 6. The guide 6 is a groove. The guide 6 may be a rib. The guide 6 extends in the installation direction of the developing cartridge 4. The guide 6 has an upstream end 6A and a downstream end 6B in the installation direction of the developing cartridge 4. The guide 6 includes a first guide 60 and a second guide 61.

The first guide 60 guides the developing shaft 41 when the developing cartridge 4 is installed into the apparatus main body 2, and guides the drum shaft 31 when the drum cartridge 3 is installed into the apparatus main body 2. That is, the first guide 60 guides the developing shaft 41 and the drum shaft 31. Specifically, the first guide 60 guides the first boss 47A and the protrusion 43 including the one end portion 41A of the developing shaft 41 when the developing cartridge 4 is installed into the apparatus main body 2, and guides the one end portion 31A of the drum shaft 31 when the drum cartridge 3 is installed into the apparatus main body 2. The first guide 60 allows entrance of the protrusion 43 and the drum shaft 31. The first guide 60 is a groove. The first guide 60 has a length (height) larger than or equal to the diameter of the developing shaft 41 in the direction perpendicular to both the axial direction and the installation direction of the developing cartridge 4. The diameter of the developing shaft 41 is larger than the diameter of the drum shaft 31. The first guide 60 has a length larger than or equal to the diameter of the protrusion 43 in the direction perpendicular to both the axial direction and the installation direction of the developing cartridge 4. The first guide 60 has an upstream end 60A and a downstream end 60B in the installation direction of the developing cartridge 4 (see FIG. 7A). The upstream end 60A of the first guide 60 is the upstream end 6A of the guide 6. The upstream end 60A of the first guide 60 is located at the downstream side of the downstream end 24B of the main body guide 24 in the installation direction of the developing cartridge 4. The upstream end 60A of the first guide 60 is wider toward the downstream end 24B of the main body guide 24. The upstream end 60A of the first guide 60 is opened toward the cover 22 (see FIG. 2) in a state where the cover 22 is located at the closed position. The downstream end 60B of the first guide 60 is in communication with the second guide 61. The downstream end 60B of the first guide 60 has a concave portion 62 that is concave along the protrusion 43.

The second guide 61 is located at the downstream side of the first guide 60 in the installation direction of the developing cartridge 4. The second guide 61 guides the drum shaft 31 when the drum cartridge 3 is installed into the apparatus main body 2. Specifically, the second guide 61 allows entrance of the one end portion 31A of the drum shaft 31 having passed the first guide 60, and guides the one end portion 31A toward the first main body drum guide 26A. On the other hand, the second guide 61 prohibits entrance of the protrusion 43 when the developing cartridge 4 is installed into the apparatus main body 2. Hence, in a state where the developing cartridge 4 is installed in the apparatus main body 2, the protrusion 43 is located at the downstream end 60B of the first guide 60 and is fitted in the concave portion 62. The second guide 61 is a groove. The second guide 61 has a length (height) larger than or equal to the diameter of the drum shaft 31 and smaller than the diameter of the developing shaft 41 in the direction perpendicular to both the axial direction and the installation direction of the developing cartridge 4. The length of the second guide 61 in the axial direction is shorter than the length of the first guide 60 in the axial direction (see FIG. 4). The second guide 61 has an upstream end and a downstream end in the installation direction of the developing cartridge 4. The downstream end of the second guide 61 is the downstream end 6B of the guide 6. The downstream end of the second guide 61 allows passage of the drum shaft 31.

2.4.2 First Pressing Spring 51

In a state where the developing cartridge 4 is installed in the apparatus main body 2, the first pressing spring 51 presses the protrusion 43 downward from above and causes the protrusion 43 to contact the guide 6. Specifically, in a state where the developing cartridge 4 is installed in the apparatus main body 2, the first pressing spring 51 presses the protrusion 43 downward from above and causes the protrusion 43 to contact the concave portion 62 of the first guide 60. The first pressing spring 51 is located above the protrusion 43 that is fitted in the concave portion 62 of the first guide 60. The first pressing spring 51 is arranged in a groove 52 formed in the swing plate 5. The first pressing spring 51 extends in the upper-lower direction. The upper end of the first pressing spring 51 contacts an inner surface of the groove 52. The lower end of the first pressing spring 51 contacts a swing portion 53 swingably provided at the swing plate 5. The swing portion 53 contacts the protrusion 43 located at the downstream end 60B of the first guide 60. In a state where the swing portion 53 contacts the protrusion 43, the first pressing spring 51 is compressed in the upper-lower direction. In a compressed state, the first pressing spring 51 presses the protrusion 43 with elastic force.

2.4.3 First Position and Second Position of Swing Plate 5

Figure 7A:
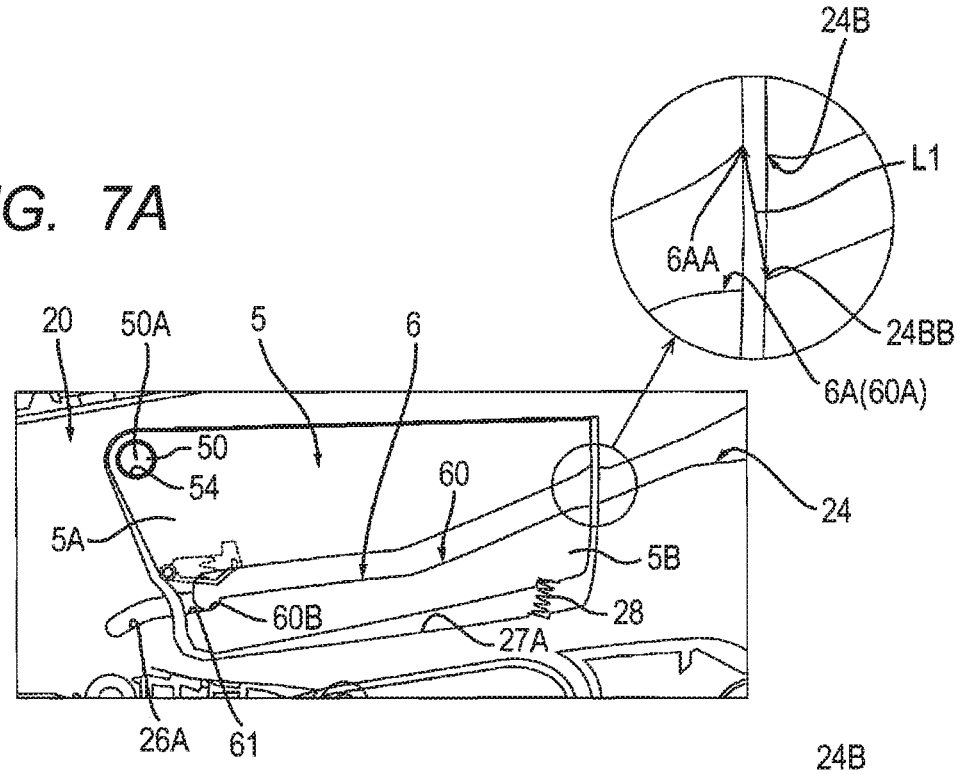
FIG. 7A is an enlarged view of the swing plate located at the first position shown in FIG. 5.
Figure 7B:
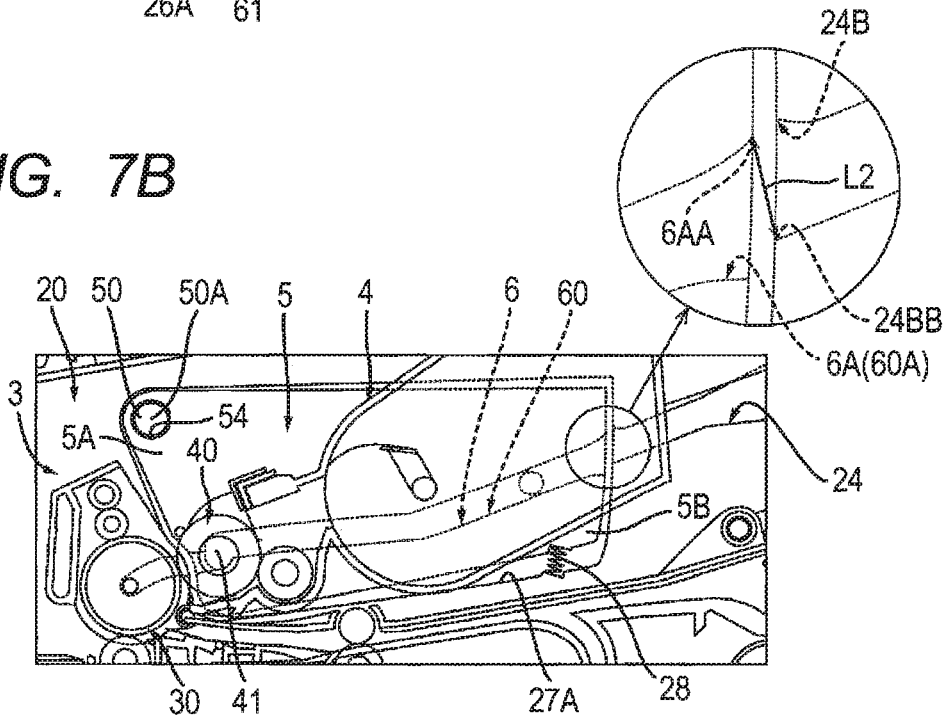
FIG. 7B is an enlarged view of the swing plate located at the second position shown in FIG. 2.

As shown in FIG. 7A and FIG. 7B, the swing plate 5 is configured to swingably move between: a first position for allowing the developing cartridge 4 to be guided from the main body guide 24 to the swing plate 5 (see FIG. 7A); and a second position for interfering with the developing cartridge 4 to be guided from the swing plate 5 to the main body guide 24 and for interfering with the developing cartridge 4 to be guided from the main body guide 24 to the swing plate 5 (see FIG. 7B). The swing plate 5 is configured to swingably move between the first position and the second position about a swing center (swing axis) 50A extending in the axial direction that is the direction intersecting the installation direction of the developing cartridge 4. In a state where the developing cartridge 4 is installed in the apparatus main body 2, the swing center 50A of the swing plate 5 is located at a higher position than the developing roller 40 (see FIG. 7B). The swing plate 5 extends in a direction intersecting the axial direction. The swing plate 5 includes one end portion 5A close to the photosensitive drum 30 and another end portion 5B far from the photosensitive drum 30 in the installation direction of the developing cartridge 4. The other end portion 5B is closer to the opening 21 than the one end portion 5A is (see FIG. 5). The swing center 50A is located at the one end portion 5A of the swing plate 5. The swing plate 5 is formed with a through hole 54 extending along the swing center 50A of the swing plate 5. A swing shaft 50 extends from the first concave portion 27A along the swing center 50A. That is, the swing shaft 50 extends from the first concave portion 27A toward the second inner side surface 20B (see FIG. 4). Because the swing shaft 50 is inserted in the through hole 54, the swing plate 5 is configured to swingably move about the swing center 50A.

As shown in FIG. 7A, in a state where the swing plate 5 is located at the first position, the upstream end 6A of the guide 6 is located at a position where the developing shaft 41 is movable from the main body guide 24 to the guide 6, relative to the downstream end 24B of the main body guide 24. In a state where the swing plate 5 is located at the first position, the upstream end 6A of the guide 6 is aligned with the downstream end 24B of the main body guide 24. In other words, when the developing shaft 41 moves from the guide 6 to the main body guide 24 in a state where the swing plate 5 is located at the first position, the upstream end 6A of the guide 6 is located at the position at which the developing shaft 41 is movable without being caught by the downstream end 24B of the main body guide 24. Specifically, in a state where the swing plate 5 is located at the first position, an upper end 6AA of the upstream end 6A of the guide 6 and a lower end 24BB of the downstream end 24B of the main body guide 24 are spaced from each other with an interval L1 therebetween. In the direction perpendicular to the axial direction and passing through the upper end 6AA and the lower end 24BB, the length of the interval L1 is longer than the diameter of the developing shaft 41 and longer than the diameter of the protrusion 43. With this configuration, in a state where the swing plate 5 is located at the first position, the upstream end 6A of the guide 6 allows passage of the protrusion 43 including the one end portion 41A of the developing shaft 41. In other words, in a state where the swing plate 5 is located at the first position, when the protrusion 43 moves from the main body guide 24 to the guide 6, the protrusion 43 is movable without being caught by the upper end 6AA. In a state where the swing plate 5 is located at the first position, when the protrusion 43 moves from the guide 6 to the main body guide 24, the protrusion 43 is movable without being caught by the lower end 24BB.

As shown in FIG. 7B, in a state where the swing plate 5 is located at the second position, the upstream end 6A of the guide 6 is farther shifted (deviated) relative to the downstream end 24B of the main body guide 24 than when the swing plate 5 is located at the first position. In a state where the swing plate 5 is located at the second position, the upstream end 6A of the guide 6 is located at a position at which the upstream end 6A interferes with the developing shaft 41 when the developing shaft 41 moves from the main body guide 24 to the guide 6. That is, when the swing plate 5 swingably moves from the first position to the second position, the upstream end 6A of the guide 6 is shifted relative to the downstream end 24B of the main body guide 24 to an extent that the upstream end 6A interferes with the developing shaft 41 when the developing shaft 41 moves from the main body guide 24 to the guide 6. In other words, in a state where the swing plate 5 is located at the second position, the downstream end 24B of the main body guide 24 is located at a position at which the downstream end 24B interferes with the developing shaft 41 when the developing shaft 41 moves from the guide 6 to the main body guide 24. Specifically, in a state where the swing plate 5 is located at the second position, the upper end 6AA of the upstream end 6A of the guide 6 and the lower end 24BB of the downstream end 24B of the main body guide 24 are spaced from each other with an interval L2 therebetween. In the direction perpendicular to the axial direction and passing through the upper end 6AA and the lower end 24BB, the length of the interval L2 is shorter than the diameter of the protrusion 43 and shorter than the diameter of the developing shaft 41. With this configuration, in a state where the swing plate 5 is located at the second position, when the protrusion 43 including the one end portion 41A of the developing shaft 41 moves from the main body guide 24 to the guide 6, the upstream end 6A of the guide 6 interferes with the protrusion 43. Further, in a state where the swing plate 5 is located at the second position, when the protrusion 43 including the one end portion 41A of the developing shaft 41 moves from the guide 6 to the main body guide 24, the lower end 24BB interferes with the protrusion 43. The state where the swing plate 5 is located at the second position is not a state that is suitable for installing and removing the developing cartridge 4.

As shown in FIG. 7A, in a state where the developing cartridge 4 is not installed in the apparatus main body 2, the swing plate 5 is located at the first position. The apparatus main body 2 includes the second pressing spring 28. The second pressing spring 28 presses the swing plate 5 in the direction from the second position toward the first position. The second pressing spring 28 is arranged at the lower side of the swing plate 5. Specifically, the second pressing spring 28 is arranged at the lower side of the other end portion 5B of the swing plate 5. The second pressing spring 28 is located between the other end portion 5B of the swing plate 5 and an inner surface of the first concave portion 27A. The second pressing spring 28 is located farther away from the swing center 50A than the first pressing spring 51 is. The second pressing spring 28 extends in the upper-lower direction. The second pressing spring 28 is compressed in the upper-lower direction in a state where the second pressing spring 28 is sandwiched between the other end portion 5B of the swing plate 5 and the inner surface of the first concave portion 27A. In a compressed state, the second pressing spring 28 presses the other end portion 5B of the swing plate 5 upward from below with elastic force. The second pressing spring 28 presses the other end portion 5B of the swing plate 5, thereby presses the swing plate 5 in the direction from the second position toward the first position.

As shown in FIG. 7B, in a state where the drum cartridge 3 and the developing cartridge 4 are installed in the apparatus main body 2, the swing plate 5 is located at the second position and causes the developing roller 40 to contact or be adjacent to the photosensitive drum 30. As shown in FIG. 2, the apparatus main body 2 includes the third pressing spring 29. In a state where the developing cartridge 4 is installed in the apparatus main body 2, the third pressing spring 29 presses the developing cartridge 4 and causes the swing plate 5 to be located at the second position against the second pressing spring 28. The pressing force of the third pressing spring 29 is larger than the pressing force of the second pressing spring 28. The third pressing spring 29 is located at the opposite side from the second pressing spring 28 with respect to the guide 6. In a state where the developing cartridge 4 is installed in the apparatus main body 2, the third pressing spring 29 is located at the upper side of the frame 42. The third pressing spring 29 extends in the upper-lower direction. The upper end of the third pressing spring 29 is fixed to the apparatus main body 2. A contact portion 29A is fixed to the lower end of the third pressing spring 29. In a state where the developing cartridge 4 is installed in the apparatus main body 2, the contact portion 29A contacts the frame 42, specifically, a concave portion 48 of the frame 42 (see FIG. 4). In a state where the contact portion 29A contacts the frame 42, the third pressing spring 29 is compressed in the upper-lower direction. In a compressed state, the third pressing spring 29 presses the frame 42 downward from above with elastic force. In a state where the developing cartridge 4 is installed in the apparatus main body 2, the third pressing spring 29 presses the frame 42 and thereby causes the swing plate 5 to be located at the second position against the second pressing spring 28.

2.5 Detail of Second Swing Plate 55

As shown in FIG. 4, the second swing plate 55 is located spaced away from the swing plate 5 in the axial direction. The second swing plate 55 has the same shape as the swing plate 5. The second swing plate 55 includes a guide 7 having the same shape as the guide 6. The second swing plate 55 is arranged in the second concave portion 27B. The second swing plate 55 is configured to swingably move between the first position and the second position, as the swing plate 5 is. The apparatus main body 2 includes a fourth pressing spring (not shown) having the same shape as the second pressing spring 28. The fourth pressing spring presses the second swing plate 55 in the direction from the second position toward the first position. The fourth pressing spring is arranged at the lower side of the second swing plate 55. The apparatus main body 2 also includes a fifth pressing spring 38 having the same shape as the third pressing spring 29. In a state where the developing cartridge 4 is installed in the apparatus main body 2, the fifth pressing spring 38 presses the developing cartridge 4 and causes the second swing plate 55 to be located at the second position against the fourth pressing spring.

2.6 Installation of Drum Cartridge 3 and Developing Cartridge 4

Next, installation of the drum cartridge 3 and the developing cartridge 4 into the apparatus main body 2 will be described. Note that the developing cartridge 4 is installed into the apparatus main body 2 after the drum cartridge 3 is installed into the apparatus main body 2.

As shown in FIG. 5, in order to install the drum cartridge 3 and the developing cartridge 4 into the apparatus main body 2, the user first opens the cover 22 to be located at the open position. At this time, the swing plate 5 is located at the first position. And, as shown in FIG. 3, the user fits the drum cartridge 3 into the main body guide 24 and pushes the drum cartridge 3 toward the internal space 2B of the apparatus main body 2. Then, the drum cartridge 3 is guided by the main body guide 24 and then guided by the guide 6 of the swing plate 5 and then guided by the first main body drum guide 26A. At this time, the drum shaft 31 sequentially passes through the main body guide 24 and the guide 6, and then reaches the first main body drum guide 26A. With this operation, the drum cartridge 3 is located at the position at which the photosensitive drum 30 contacts the transfer roller 12. That is, installation of the drum cartridge 3 into the apparatus main body 2 is completed.

Next, as shown in FIG. 6, the user fits the developing cartridge 4 into the main body guide 24 and pushes the developing cartridge 4 toward the internal space 2B of the apparatus main body 2. Then, the developing cartridge 4 is guided by the main body guide 24, and then the developing cartridge 4 is guided by the first guide 60 of the guide 6. At this time, the protrusion 43 passes through the main body guide 24 and reaches the downstream end 60B of the first guide 60. Then, the protrusion 43 is fitted in the concave portion 62. The first boss 47A passes through the main body guide 24 and thereafter is located in the first guide 60. With this operation, the developing cartridge 4 is supported by the swing plate 5. In a state where the developing cartridge 4 is supported by the swing plate 5, the third pressing spring 29 presses the developing cartridge 4. With this configuration, as shown in FIG. 2, the swing plate 5 swingably moves from the first position to the second position. And, the developing roller 40 contacts the photosensitive drum 30. This completes installation of the developing cartridge 4 into the apparatus main body 2.

2.7 Operations and Effects

In the image forming apparatus 10, the guide 6 of the swing plate 5 guides installation of the developing cartridge 4 into the apparatus main body 2. Hence, the developing cartridge 4 can be installed smoothly into the apparatus main body 2. And, the swing plate 5 supports the developing cartridge 4 installed in the apparatus main body 2. Hence, when the swing plate 5 swingably moves in a state where the drum cartridge 3 and the developing cartridge 4 are installed in the apparatus main body 2, the developing cartridge 4 moves together with the swing movement of the swing plate 5. As a result, the developing roller 40 can be moved relative to the photosensitive drum 30.

In the image forming apparatus 10, the swing plate 5 swingably supports the developing cartridge 4. Further, the third pressing spring 29 urges the developing cartridge 4 from the direction intersecting the installation direction of the developing cartridge 4 and not interfering with installation of the developing cartridge 4. In a configuration where the cover 22 is located at the opposite side from the photosensitive drum 30 with respect to the developing roller 40 as in the image forming apparatus 10, that is, in a configuration where the developing roller 40 and the photosensitive drum 30 are arranged in this order from the cover 22 toward the inside of the internal space 2B, it is necessary to urge the developing roller 40 against the photosensitive drum 30 in the direction from the cover 22 toward the internal space 2B with a spring or the like. However, such spring becomes an obstacle that interferes with the developing cartridge when the developing cartridge is installed. Thus, in the image forming apparatus 10, the third pressing spring 29 urges the developing cartridge 4 from the direction intersecting the installation direction of the developing cartridge 4 and not interfering with installation of the developing cartridge 4. With this configuration, the third pressing spring 29 does not become an obstacle of installation of the developing cartridge 4.

3. Second Embodiment

An image forming apparatus 70 of a second embodiment will be described while referring to FIG. 8 to FIG. 10B. In the image forming apparatus 70 of the second embodiment, parts and components similar to those in the above-described first embodiment are designated by the same reference numerals to avoid duplicating description.

Figure 8:
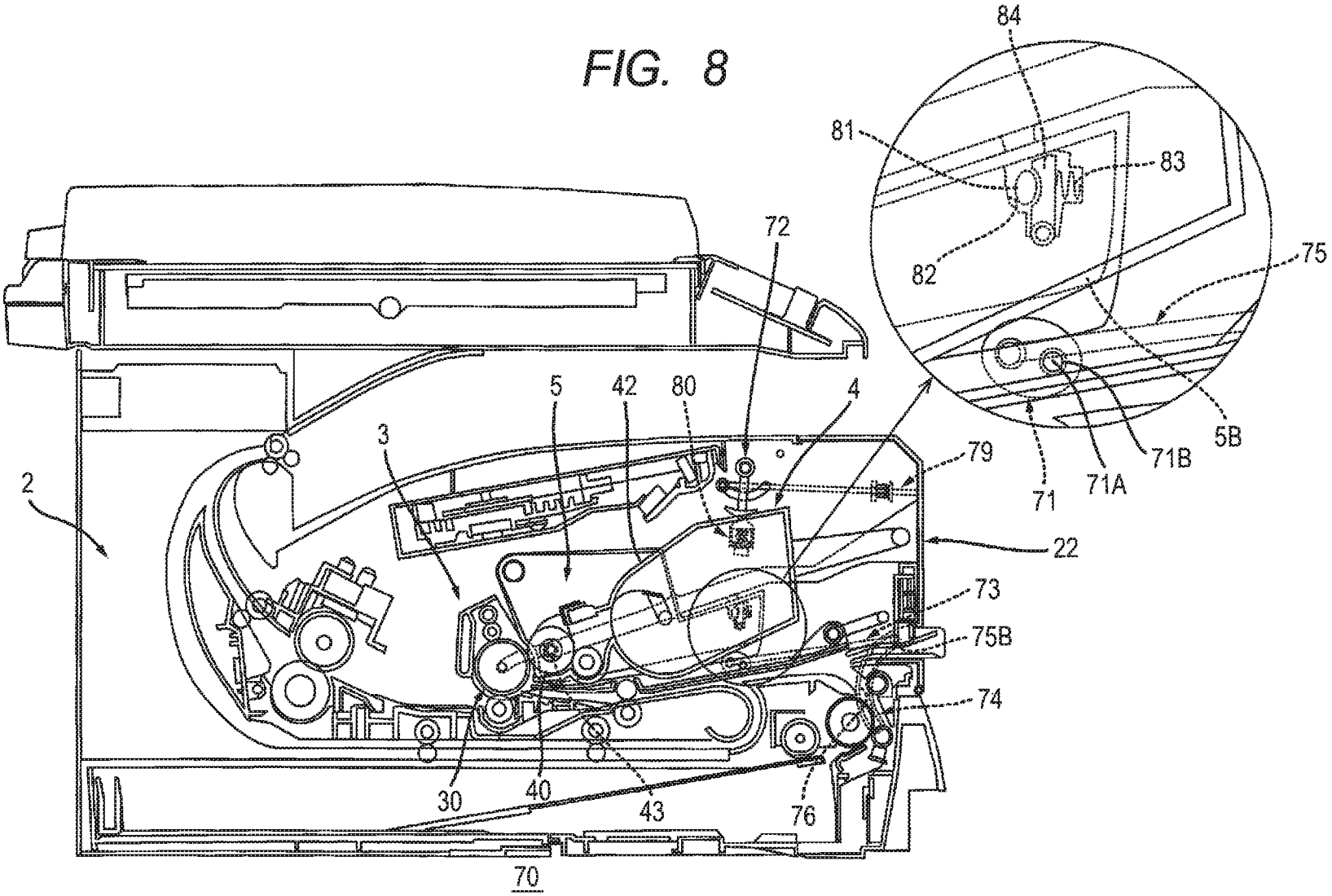
FIG. 8 is a cross-sectional view of an image forming apparatus according to a second embodiment, and shows a state where a cam is located at a pressing release position.
Figure 9:
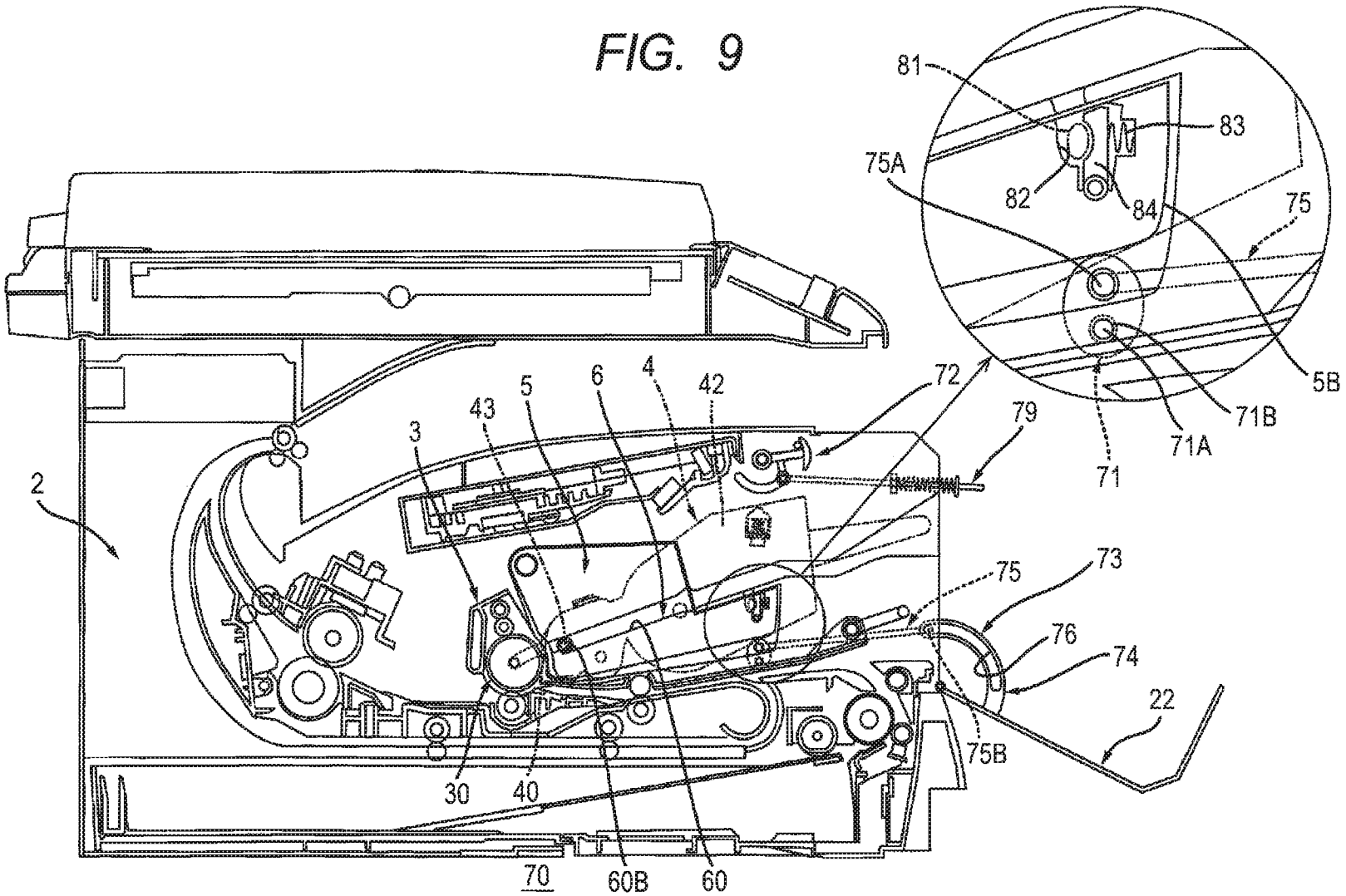
FIG. 9 is a cross-sectional view of the image forming apparatus shown in FIG. 8, and shows a state where the cam is located at a pressing position.

As shown in FIG. 8 and FIG. 9, in the image forming apparatus 70, the swing plate 5 moves between the first position and the second position in conjunction with movement of the cover 22. Specifically, the swing plate 5 is located at the second position in a state where the cover 22 is located at the closed position (see FIG. 8), and the swing plate 5 is located at the first position in a state where the cover 22 is located at the open position (see FIG. 9). In a state where the drum cartridge 3 and the developing cartridge 4 are installed in the apparatus main body 2, the developing roller 40 contacts the photosensitive drum 30 (see FIG. 8) when the swing plate 5 is located at the second position, and the developing roller 40 is separated from the photosensitive drum 30 (see FIG. 9) when the swing plate 5 is located at the first position. Hereinafter, the detailed structure of the image forming apparatus 70 of the second embodiment will be described.

3.1 Detail of Apparatus Main Body 2

As shown in FIG. 8 and FIG. 9, the apparatus main body 2 includes a cam 71, a coupling member 73, a contact member 72, and a link member 79.

The cam 71 is arranged at the lower side of the swing plate 5. Specifically, the cam 71 is arranged at the lower side of the other end portion 5B of the swing plate 5. The cam 71 moves by interlocking with movement of the cover 22. The cam 71 is configured to move between: a pressing position (see FIG. 9) at which the cam 71 presses the swing plate 5 toward the first position in a state where the cover 22 is located at the open position; and a pressing release position (see FIG. 8) at which pressing against the swing plate 5 is stopped and the swing plate 5 is located at the second position in a state where the cover 22 is located at the closed position.

The cam 71 is configured to rotatably move between the pressing position and the pressing release position about an axis 71A extending in the axial direction. The cam 71 has an elliptical shape. The axis 71A is located at a position shifted from the center of the cam 71. The cam 71 includes a rotational shaft 71B extending along the axis 71A. The rotational shaft 71B is rotatably supported by the apparatus main body 2. In a state where the cam 71 is located at the pressing position (see FIG. 9), the cam 71 contacts the swing plate 5. In this state, the cam 71 presses the swing plate 5 upward from below. With this configuration, the cam 71 presses the swing plate 5 toward the first position. In a state where the cam 71 is located at the pressing release position, the cam 71 is separated from the swing plate 5 (see FIG. 8). With this configuration, the cam 71 stops pressing against the swing plate 5 and causes the swing plate 5 to be located at the second position.

As shown in FIG. 9, the coupling member 73 couples the cover 22 with the cam 71. The coupling member 73 causes the cover 22 and the cam 71 to move in an interlocking manner. When the cover 22 moves from the open position to the closed position, the coupling member 73 causes the cam 71 to move from the pressing position to the pressing release position. When the cover 22 moves from the closed position to the open position, the coupling member 73 causes the cam 71 to move from the pressing release position to the pressing position. The coupling member 73 includes a first coupling portion 74 and a second coupling portion 75. The first coupling portion 74 is fixed to the cover 22. The first coupling portion 74 has an elongated hole 76. The second coupling portion 75 couples the cam 71 with the first coupling portion 74. The second coupling portion 75 has one end coupled with the cam 71 and another end coupled with the first coupling portion 74. The one end of the second coupling portion 75 is located away from the other end of the second coupling portion 75. The second coupling portion 75 includes a coupling shaft 75A and a boss 75B. The coupling shaft 75A is located at the one end of the second coupling portion 75. The coupling shaft 75A extends in the axial direction. The coupling shaft 75A is connected to a position away from the axis 71A in the cam 71. The coupling shaft 75A is configured to rotatably move relative to the cam 71. The boss 75B is located at the other end of the second coupling portion 75. The boss 75B extends in the axial direction. The boss 75B is fitted in the elongated hole 76 of the first coupling portion 74. The elongated hole 76 extends in the rotational movement direction of the cover 22. The elongated hole 76 has one end and another end in the rotational movement direction of the cover 22. In a state where the cover 22 is located at the open position, the boss 75B is located at the one end of the elongated hole 76 and contacts the first coupling portion 74. With this operation, the second coupling portion 75 is pulled by the first coupling portion 74, and the cam 71 is located at the pressing position. As shown in FIG. 8, when the cover 22 moves from the open position to the closed position, the boss 75B moves from the one end to the other end of the elongated hole 76 and contacts the first coupling portion 74. With this operation, the second coupling portion 75 is pushed by the first coupling portion 74, and causes the cam 71 to move from the pressing position to the pressing release position.

Figure 10A:
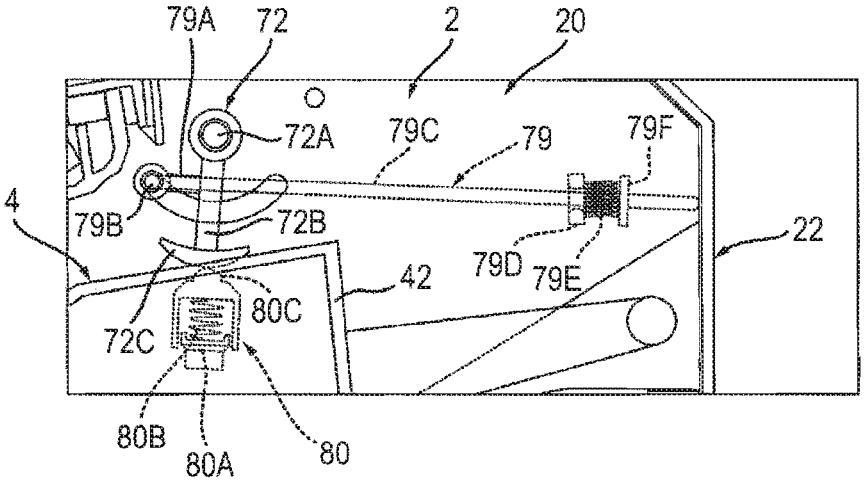
FIG. 10A is an enlarged view of a contact member located at a contact position shown in FIG. 8.
Figure 10B:
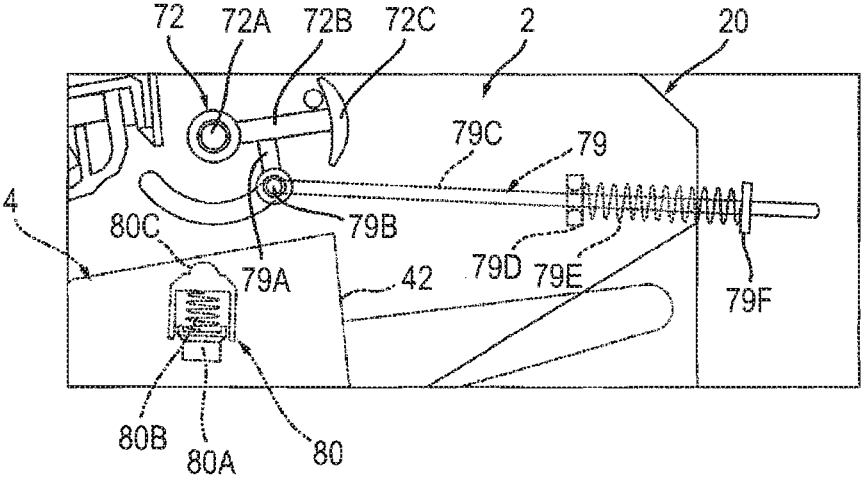
FIG. 10B is an enlarged view of the contact member located at a noncontact position shown in FIG. 9.

As shown in FIG. 10A and FIG. 10B, the contact member 72 is configured to move between: a contact position at which the contact member 72 contacts the developing cartridge 4 (see FIG. 10A) in a state where the developing cartridge 4 is installed in the apparatus main body 2 and the cover 22 is located at the closed position; and a noncontact position at which a contact with the developing cartridge 4 is stopped (see FIG. 10B) in a state where the developing cartridge 4 is installed in the apparatus main body 2 and the cover 22 is located at the open position. The contact member 72 moves by interlocking with movement of the cover 22. The contact member 72 is located at the opposite side from the cam 71 with respect to the main body guide 24 (see FIG. 8). In a state where the developing cartridge 4 is installed in the apparatus main body 2, the contact member 72 is located at the upper side of the frame 42. The contact member 72 is configured to rotatably move between the pressing position and the pressing release position about a rotational axis extending in the axial direction. The contact member 72 includes a rotational shaft 72A, an arm 72B, and a contact portion 72C. The rotational shaft 72A extends along the rotational axis of the contact member 72. The rotational shaft 72A is rotatably supported by the apparatus main body 2. The arm 72B includes one end fixed to the rotational shaft 72A and another end located away from the one end. The contact portion 72C is fixed to the other end of the arm 72B. The contact portion 72C contacts the developing cartridge 4 in a state where the contact member 72 is located at the contact position (see FIG. 10A), and separates from the developing cartridge 4 in a state where the contact member 72 is located at the noncontact position (see FIG. 10B).

The link member 79 causes the cover 22 and the contact member 72 to move in an interlocking manner. When the cover 22 moves from the open position to the closed position, the link member 79 causes the contact member 72 to move from the noncontact position to the contact position. When the cover 22 moves from the closed position to the open position, the link member 79 causes the contact member 72 to move from the contact position to the noncontact position. The link member 79 includes a first arm 79A, a coupling shaft 79B, a second arm 79C, a support portion 79D, and a spring 79E. The first arm 79A couples the arm 72B of the contact member 72 with the coupling shaft 79B. The coupling shaft 79B couples the first arm 79A with the second arm 79C. The coupling shaft 79B extends in the axial direction. The coupling shaft 79B is configured to rotate relative to the first arm 79A and the second arm 79C. The second arm 79C extends in a direction intersecting both the axial direction and the upper-lower direction. The second arm 79C has one end and an other end in the extending direction. The one end of the second arm 79C is connected to the coupling shaft 79B. In a state where the cover 22 is located at the open position, the other end of the second arm 79C protrudes to outside the main casing 20 (see FIG. 10B). In a state where the cover 22 is located at the closed position, the other end of the second arm 79C contacts the cover 22 and is located inside the main casing 20 (see FIG. 10A). The support portion 79D is fixed to the apparatus main body 2. The support portion 79D movably supports the second arm 79C. The support portion 79D has a hole. The second arm 79C is inserted in the hole of the support portion 79D. The second arm 79C has a rib 79F. The rib 79F is located at the opposite side from the coupling shaft 79B with respect to the support portion 79D. The spring 79E is arranged between the support portion 79D and the rib 79F. The spring 79E extends in the same direction as the second arm 79C. In a state where the cover 22 is located at the closed position, the spring 79E is compressed by being sandwiched between the support portion 79D and the rib 79F (see FIG. 10A). When the cover 22 moves from the closed position to the open position and the contact between the cover 22 and the second arm 79C is ended, the spring 79E presses the rib 79F and thereby causes the other end of the second arm 79C to protrude to outside the main casing 20 (see FIG. 10B).

Although not shown in the drawings, the apparatus main body 2 may include a second cam having the same shape as the cam 71, a second coupling member having the same shape as the coupling member 73, a second contact member having the same shape as the contact member 72, and a second link member having the same shape as the link member 79. The second cam is configured to move between: a pressing position at which the second cam presses the second swing plate 55 (see FIG. 4) toward the first position in a state where the cover 22 is located at the open position; and a pressing release position at which pressing against the second swing plate 55 is stopped and the second cam causes the second swing plate 55 to be located at the second position in a state where the cover 22 is located at the closed position. The second coupling member causes the cover 22 and the second cam to move in an interlocking manner. The second contact member is configured to move between the contact position and the noncontact position, as the contact member 72 is. The second link member causes the cover 22 and the second contact member to move in an interlocking manner.

3.2 Detail of Developing Cartridge 4

The developing cartridge 4 further includes a contact unit 80 and a protruding portion 81. As shown in FIG. 10A, in a state where the contact member 72 is located at the contact position, the contact unit 80 contacts the contact member 72. The contact unit 80 is located at one end side with respect to the frame 42 in the axial direction. Although not shown in the drawings, the developing cartridge 4 may include a second contact unit having the same shape as the contact unit 80. The second contact unit is located at the other end side with respect to the frame 42 in the axial direction. The contact unit 80 includes a protruding plate 80A, a spring 80B, and a developing contact portion 80C. The protruding plate 80A protrudes from the frame 42. The spring 80B extends in the upper-lower direction. The developing contact portion 80C is arranged above the spring 80B. The lower end of the spring 80B contacts the protruding plate 80A. The upper end of the spring 80B contacts the developing contact portion 80C. In a state where the contact member 72 is located at the contact position, the developing contact portion 80C is contacted by the contact portion 72C. In a state where the developing contact portion 80C contacts the contact portion 72C, the spring 80B is compressed in the upper-lower direction. In a compressed state, the spring 80B presses the protruding plate 80A downward with elastic force.

As shown in FIG. 8, in a state where the developing cartridge 4 is supported by the swing plate 5, the protruding portion 81 is fitted in a receiving groove 82 (described later) formed in the swing plate 5. The protruding portion 81 is located at one end side with respect to the frame 42 in the axial direction. Although not shown in the drawings, the developing cartridge 4 may include a second protruding portion having the same shape as the protruding portion 81. The second protruding portion is located at the other end side with respect to the frame 42 in the axial direction. The protruding portion 81 is located at the upstream side of the protrusion 43 with an interval therebetween in the installation direction of the developing cartridge 4.

3.3 Detail of Swing Plate 5

The swing plate 5 further includes the receiving groove 82 and a first pressing spring 83. In a state where the developing cartridge 4 is installed in the apparatus main body 2, the receiving groove 82 receives the protruding portion 81. In a state where the developing cartridge 4 is installed in the apparatus main body 2, the first pressing spring 83 presses the protruding portion 81 from the opposite side of the developing roller 40 with respect to the protruding portion 81. The first pressing spring 83 extends in a horizontal direction. One end of the first pressing spring 83 in the horizontal direction contacts an inner surface of the receiving groove 82. The other end of the first pressing spring 83 in the horizontal direction contacts a swing portion 84 swingably provided at the swing plate 5. The swing portion 84 is located between the first pressing spring 83 and the protruding portion 81 located inside the receiving groove 82. The swing portion 84 contacts the protruding portion 81 located inside the receiving groove 82. In a state where the swing portion 84 contacts the protruding portion 81, the first pressing spring 83 is compressed in the horizontal direction. In a compressed state, the first pressing spring 83 presses the protruding portion 81 toward the developing roller 40 with elastic force. Although not shown in the drawings, the second swing plate 55 may include a second receiving groove having the same shape as the receiving groove 82 and a second pressing spring having the same shape as the first pressing spring 83. In a state where the developing cartridge 4 is installed in the apparatus main body 2, the second receiving groove receives the second protruding portion. The second pressing spring presses the second protruding portion located inside the second receiving groove.

3.4 Operations and Effects

As shown in FIG. 8 and FIG. 9, the cam 71 is located at the pressing position at which the cam 71 presses the swing plate 5 toward the first position in a state where the cover 22 is located at the open position, and is located at the pressing release position at which the cam 71 causes the swing plate 5 to be located at the second position in a state where the cover 22 is located at the closed position. The cam 71 moves between the pressing position and the pressing release position in conjunction with movement of the cover 22.

Hence, when the user moves the cover 22 to be located at the open position in order to install the developing cartridge 4 into the apparatus main body 2, the swing plate 5 is located at the first position by the cam 71. With this configuration, when the user moves the developing cartridge 4 from the main body guide 24 to the guide 6 in order to install the developing cartridge 4 into the apparatus main body 2, the user does not feel poor operability due to the step between the main body guide 24 and the guide 6, compared with a case where the swing plate 5 is located at the second position. Further, in a state where the protrusion 43 of the developing cartridge 4 has reached the downstream end 60B of the first guide 60, the swing plate 5 does not swingably move and the developing roller 40 does not contact the photosensitive drum 30. Assume that, in a state where the protrusion 43 of the developing cartridge 4 reaches the downstream end 60B of the first guide 60, and the swing plate 5 swingably moves and the developing roller 40 contacts the photosensitive drum 30. In this case, the photosensitive drum 30 pushes the developing roller 40 back. Hence, it is difficult to maintain a state where the protrusion 43 of the developing cartridge 4 has reached the downstream end 60B of the first guide 60. In the embodiment, however, the photosensitive drum 30 does not push the developing roller 40 back, as described above. Thus, the protrusion 43 of the developing cartridge 4 can be maintained in a state where the protrusion 43 has reached the downstream end 60B of the first guide 60. After that, when the user moves the cover 22 to be located at the closed position, the swing plate 5 is located at the second position. With this operation, the developing roller 40 moves relative to the photosensitive drum 30, and the developing roller 40 contacts the photosensitive drum 30.

When the user moves the cover 22 from the closed position to the open position in order to remove the developing cartridge 4 from the apparatus main body 2, the swing plate 5 is moved by the cam 71 from the second position to the first position. With this operation, the developing roller 40 separates from the photosensitive drum 30. After that, the developing cartridge 4 is removed from the apparatus main body 2. At this time, too, because there is no step from the guide 6 to the main body guide 24, the user can install and remove the developing cartridge 4 without feeling poor operability. That is, after the developing roller 40 is separated from the photosensitive drum 30, the developing cartridge 4 is removed from the apparatus main body 2. Hence, the developing cartridge 4 is removed smoothly from the apparatus main body 2. In the second embodiment, too, operations and effects similar to those in the above-described first embodiment are obtained.

4. Third Embodiment

An image forming apparatus 90 of a third embodiment will be described while referring to FIG. 11 and FIG. 12. In the image forming apparatus 90 of the third embodiment, parts and components similar to those in the image forming apparatus 10 of the above-described first embodiment are designated by the same reference numerals to avoid duplicating description.

In the image forming apparatus 90, in a state where the developing cartridge 4 is installed in the apparatus main body 2, the swing plate 5 is configured to swingably move between: a first position (see FIG. 12) at which the developing roller 40 is separated from the photosensitive drum 30; and a second position (see FIG. 11) at which the developing roller 40 contacts or is more closely adjacent to the photosensitive drum 30 than at the first position. In a state where the developing cartridge 4 is installed in the apparatus main body 2 and where the swing plate 5 is located at the first position, the swing plate 5 allows the developing cartridge 4 to be guided from the main body guide 24 to the swing plate 5. In a state where the developing cartridge 4 is installed in the apparatus main body 2 and where the swing plate 5 is located at the first position, the swing plate 5 allows the developing cartridge 4 to be guided from the guide 6 to the main body guide 24.

The first position is a position at which the developing roller 40 is separated from the photosensitive drum 30 and the developing roller 40 does not contact the photosensitive drum 30 in a state where the developing cartridge 4 is installed in the apparatus main body 2. Further, the first position is a position at which movement of toner from the developing roller 40 to the photosensitive drum 30 is not possible.

The second position is a position at which the developing cartridge 4 is installed in the apparatus main body 2 and the developing roller 40 contacts the photosensitive drum 30 or a position at which the developing cartridge 4 is installed in the apparatus main body 2 and the developing roller 40 is located closer to the photosensitive drum 30 than at the first position but the developing roller 40 does not contact the photosensitive drum 30. Further, the second position is a position at which movement of toner from the developing roller 40 to the photosensitive drum 30 is possible. That is, development may be contact development that toner moves from the developing roller 40 to the photosensitive drum 30 in a state where the developing roller 40 contacts the photosensitive drum 30, or may be jumping development that toner moves from the developing roller 40 to the photosensitive drum 30 in a state where the developing roller 40 does not contact the photosensitive drum 30.

The swing plate 5 is configured to swingably move between the first position and the second position about the swing center 50A extending in the axial direction in the direction intersecting the installation direction of the developing cartridge 4. The swing center 50A of the swing plate 5 is located at a lower position than the developing roller 40 in a state where the developing cartridge 4 is installed in the apparatus main body 2. In a state where the cover 22 is located at the closed position, the swing plate 5 is located at the second position (see FIG. 11). In a state where the swing plate 5 is located at the second position, a lower end 6AB of the upstream end 6A of the guide 6 and an upper end 24BA of the downstream end 24B of the main body guide 24 are spaced from each other with the interval 12 therebetween. At this time, the interval L2 has a length less than half the diameter of the protrusion 43 of the developing cartridge 4, and the protrusion 43 cannot move from the guide 6 to the main body guide 24, thereby prohibiting movement of the protrusion 43. In a state where the cover 22 is located at the open position, the swing plate 5 is located at the first position due to its own weight (see FIG. 12). In a state where the swing plate 5 is located at the first position, the lower end 6AB of the upstream end 6A of the guide 6 and the upper end 24BA of the downstream end 24B of the main body guide 24 are spaced from each other with the interval L therebetween.

The detailed structure of the image forming apparatus 90 of the third embodiment will be described below.

4.1 Detail of Apparatus Main Body 2

The apparatus main body 2 further includes a pressing member 91 and a coupling member 92.

The pressing member 91 is configured to move between: a pressing position (see FIG. 11) at which the pressing member 91 presses the swing plate 5 toward the second position in a state where the cover 22 is located at the closed position; and a pressing release position (see FIG. 12) at which pressing against the swing plate 5 is stopped and the pressing member 91 causes the swing plate 5 to be located at the first position in a state where the cover 22 is located at the open position. The pressing member 91 moves by interlocking with movement of the cover 22.

Figure 11:
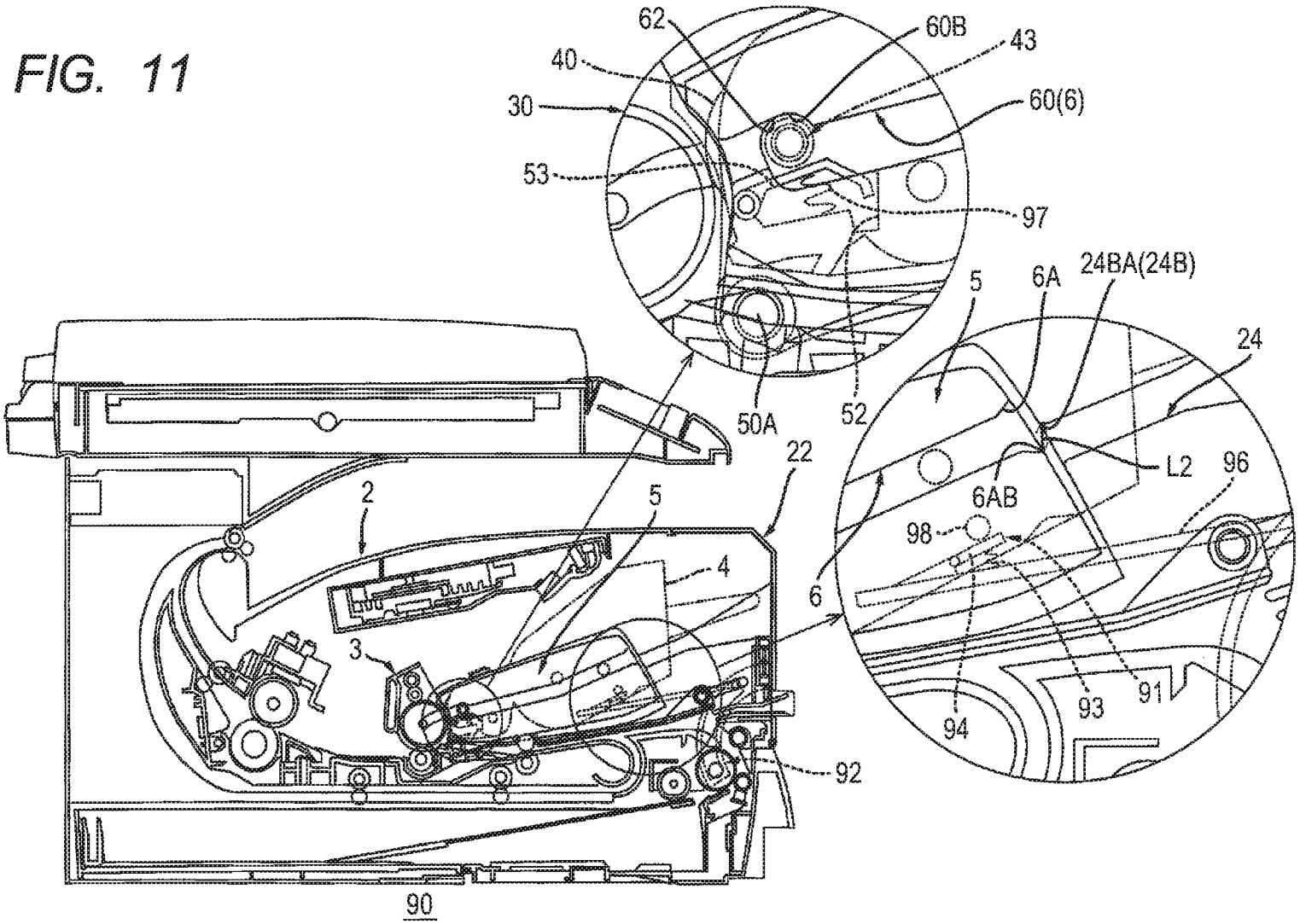
FIG. 11 is a cross-sectional view of an image forming apparatus according to a third embodiment, and shows a state where a pressing member is located at a pressing position.
Figure 12:
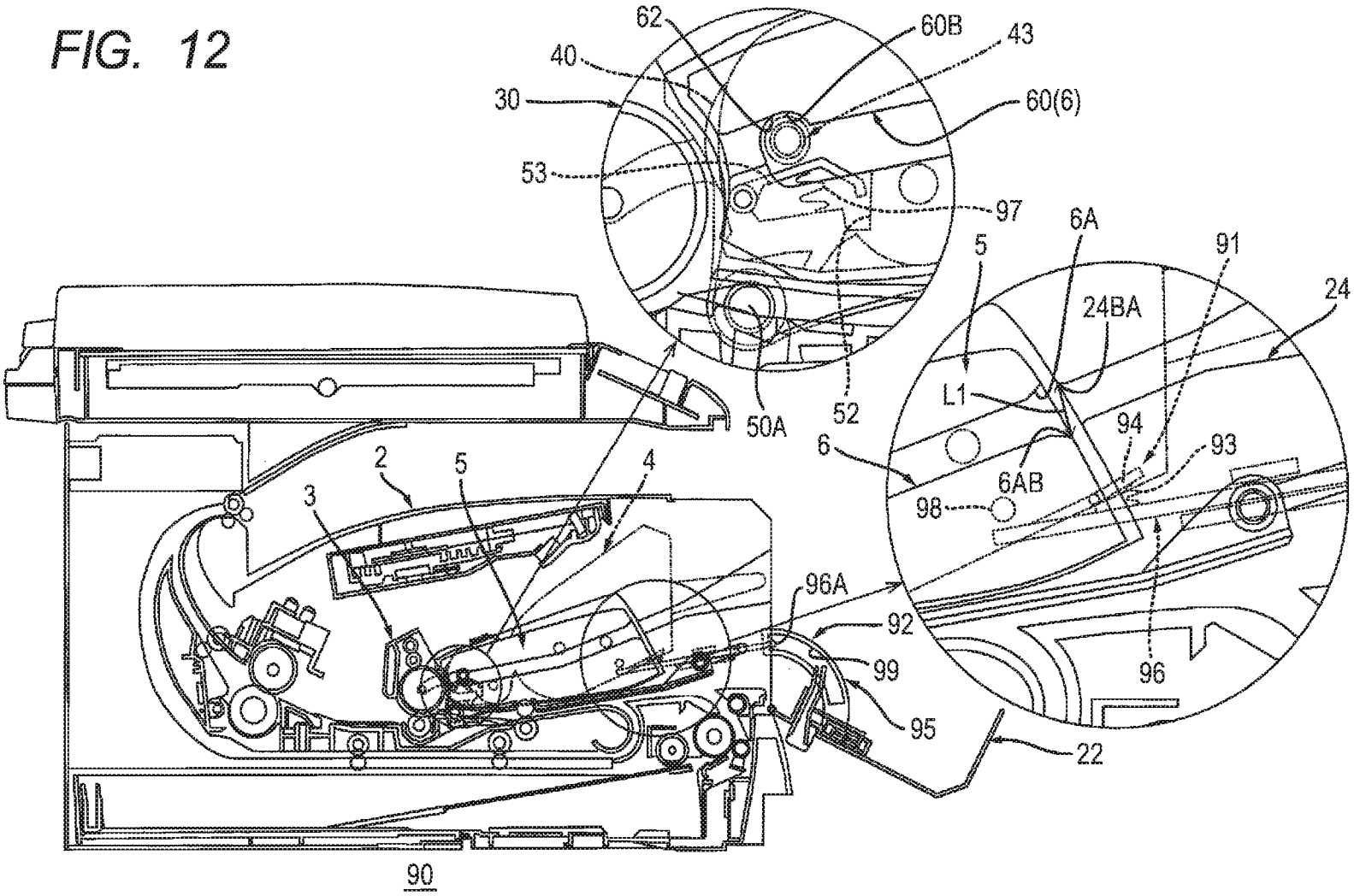
FIG. 12 is a cross-sectional view of the image forming apparatus shown in FIG. 11, and shows a state where the pressing member is located at a pressing release position.

As shown in FIG. 11, the pressing member 91 is supported by a second coupling portion 96 (described later) of the coupling member 92. The pressing member 91 is arranged at the upper side of the second coupling portion 96. The pressing member 91 includes a pressing spring 93 and a pressing plate 94. In a state where the pressing member 91 is located at the pressing position, the pressing spring 93 presses the swing plate 5 upward from below. In a state where the pressing member 91 is located at the pressing position, the pressing spring 93 is located at the lower side of a boss 98 of the swing plate 5. The boss 98 protrudes from the swing plate 5. The pressing spring 93 extends in the upper-lower direction. The pressing spring 93 is arranged between the second coupling portion 96 and the pressing plate 94. The lower end of the pressing spring 93 contacts the upper surface of the second coupling portion 96. The upper end of the pressing spring 93 contacts the pressing plate 94. The pressing plate 94 is swingably provided at the upper surface of the second coupling portion 96. The pressing plate 94 contacts the swing plate 5 in a state where the pressing member 91 is located at the pressing position. Specifically, the pressing plate 94 contacts the boss 98 in a state where the pressing member 91 is located at the pressing position. In a state where the pressing plate 94 contacts the swing plate 5, the pressing spring 93 is compressed in the upper-lower direction. In a compressed state, the pressing spring 93 presses the swing plate 5 with elastic force. With this configuration, the pressing member 91 presses the swing plate 5 toward the second position. As shown in FIG. 12, in a state where the pressing member 91 is located at the pressing release position, the pressing plate 94 is separated from the swing plate 5. With this configuration, the pressing member 91 stops pressing against the swing plate 5. Then, the swing plate 5 moves from the second position to the first position due to its own weight.

The coupling member 92 couples the cover 22 with the pressing member 91. The coupling member 92 causes the cover 22 and the pressing member 91 to move in an interlocking manner. When the cover 22 moves from the open position to the closed position, the coupling member 92 causes the pressing member 91 to move from the pressing release position to the pressing position. When the cover 22 moves from the closed position to the open position, the coupling member 92 causes the pressing member 91 to move from the pressing position to the pressing release position. The coupling member 92 includes a first coupling portion 95 and the second coupling portion 96. The first coupling portion 95 is fixed to the cover 22. The first coupling portion 95 is formed with an elongated hole 99. The second coupling portion 96 couples the pressing member 91 with the first coupling portion 95. The second coupling portion 96 has one end supporting the pressing member 91 and another end coupled with the first coupling portion 95. The one end of the second coupling portion 96 is located away from the other end of the second coupling portion 96. The second coupling portion 96 includes a boss 96A. The boss 96A is located at the other end of the second coupling portion 96. The boss 96A extends in the axial direction. The boss 96A is fitted in the elongated hole 99 of the first coupling portion 95. The elongated hole 99 extends in the rotational movement direction of the cover 22. The elongated hole 99 has one end and another end in the rotational movement direction of the cover 22. In a state where the cover 22 is located at the open position, the boss 96A is located at the one end of the elongated hole 99 and contacts the first coupling portion 95. With this configuration, the second coupling portion 96 is pulled by the first coupling portion 95, and the pressing member 91 is located at the pressing release position. When the cover 22 moves from the open position to the closed position, the boss 96A moves from the one end to the other end of the elongated hole 99 and contacts the first coupling portion 95. With this configuration, the second coupling portion 96 is pressed by the first coupling portion 95, and causes the pressing member 91 to move from the pressing release position to the pressing position (see FIG. 11).

4.2 Detail of Swing Plate 5

As shown in FIG. 11, the swing plate 5 further includes a first pressing spring 97. In a state where the developing cartridge 4 is installed in the apparatus main body 2, the first pressing spring 97 presses the protrusion 43 upward from below and causes the protrusion 43 to contact the guide 6. Specifically, in a state where the developing cartridge 4 is installed in the apparatus main body 2, the first pressing spring 97 presses the protrusion 43 upward from below and causes the protrusion 43 to contact the downstream end 60B of the first guide 60. In a state where the developing cartridge 4 is installed in the apparatus main body 2, the first pressing spring 97 is located at the lower side of the protrusion 43 located at the downstream end 60B of the first guide 60. The first pressing spring 97 is arranged in the groove 52 formed in the swing plate 5. The first pressing spring 97 extends in the upper-lower direction. The lower end of the first pressing spring 97 contacts the inner surface of the groove 52. The upper end of the first pressing spring 97 contacts the swing portion 53 provided swingably at the swing plate 5. The swing portion 53 contacts the protrusion 43 located at the downstream end 60B of the first guide 60. In a state where the swing portion 53 contacts the protrusion 43, the first pressing spring 97 is compressed in the upper-lower direction. In a compressed state, the first pressing spring 97 presses the protrusion 43 with elastic force.

4.3 Operations and Effects

In the third embodiment, too, operations and effects similar to those in the above-described first and second embodiments are obtained.

5. Fourth Embodiment

Figure 13:
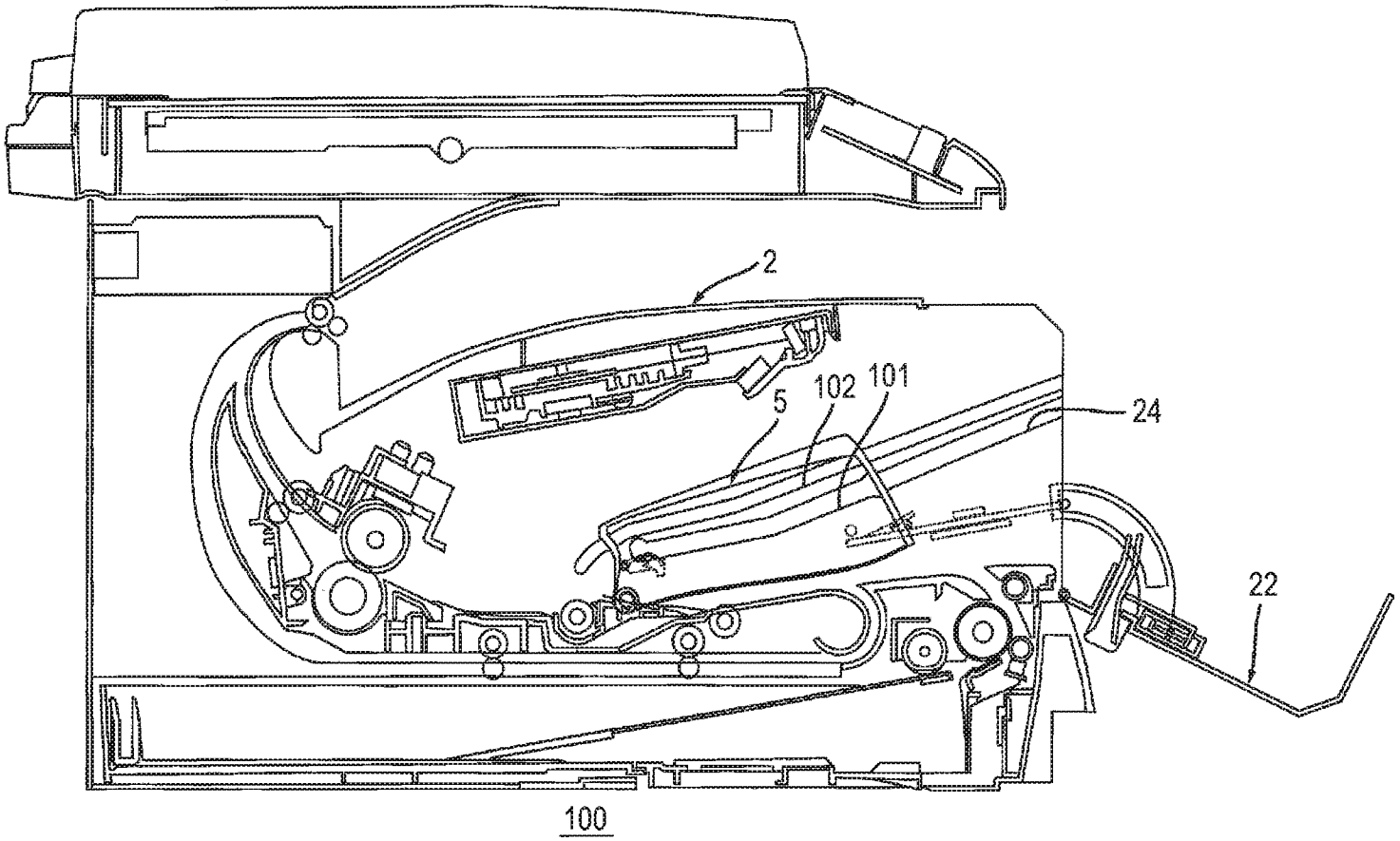
FIG. 13 is a cross-sectional view of an apparatus main body of an image forming apparatus according to a fourth embodiment.

An image forming apparatus 100 of a fourth embodiment will be described while referring to FIG. 13. In the image forming apparatus 100 of the fourth embodiment, parts and components similar to those in the above-described first to third embodiments are designated by the same reference numerals to avoid duplicating description.

In the image forming apparatus 100, the swing plate 5 has a developing guide 101 configured to guide installation of the developing cartridge 4 into the apparatus main body 2 and a drum guide 102 configured to guide installation of the drum cartridge 3 into the apparatus main body 2. That is, the swing plate 5 includes the developing guide 101 and the drum guide 102 as separate guides. The developing guide 101 guides the developing shaft 41 when the developing cartridge 4 is installed into the apparatus main body 2. The developing guide 101 has the same shape as the above-described first guide 60. The drum guide 102 guides the drum shaft 31 when the drum cartridge 3 is installed into the apparatus main body 2. In the fourth embodiment, too, operations and effects similar to those in the above-described first to third embodiments are obtained.

While the disclosure has been described in detail with reference to the above aspects thereof, it would be apparent to those skilled in the art that various changes and modifications may be made therein without departing from the scope of the claims.

What is claimed is:

1. An image forming apparatus comprising:

an apparatus main body including:

a main casing having an opening; and a cover configured to rotatably move about a rotational axis between an open position at which the opening is opened and a closed position at which the opening is closed;

a drum cartridge including a photosensitive drum and configured to be installed into the apparatus main body through the opening;

a developing cartridge including a developing roller and configured to be installed into the apparatus main body through the opening; and a swing plate attached swingably to the apparatus main body, the swing plate being configured to support the developing cartridge, the swing plate including a guide configured to guide installation of the developing cartridge into the apparatus main body, the swing plate being configured to swingably move in a state where the drum cartridge and the developing cartridge are installed in the apparatus main body, thereby causing the developing roller to move relative to the photosensitive drum, and the swing plate including a drum guide configured to guide installation of the drum cartridge into the apparatus main body.

2. The image forming apparatus according to claim 1, wherein the guide and the drum guide are a common guide.

3. The image forming apparatus according to claim 2, wherein the photosensitive drum includes a drum shaft extending along a rotational axis of the photosensitive drum;

wherein the developing roller includes a developing shaft extending along a rotational axis of the developing roller;

wherein a diameter of the developing shaft is larger than a diameter of the drum shaft; and wherein the drum guide includes:

a first guide portion formed as a groove, the first guide portion having a width larger than or equal to the diameter of the developing shaft in a particular direction intersecting both an axial direction of the developing roller and an installation direction of the developing cartridge, the first guide portion being configured to guide the drum shaft and the developing shaft; and a second guide portion formed as a groove, the second guide portion having a width larger than or equal to the diameter of the drum shaft and smaller than the diameter of the developing shaft in the particular direction, the second guide portion being configured to guide the drum shaft.

4. The image forming apparatus according to claim 1, wherein the apparatus main body includes a main body guide configured to guide installation of the developing cartridge into the apparatus main body, the main body guide being configured to guide the developing cartridge toward the swing plate;

wherein, in a state where the developing cartridge is installed in the apparatus main body, the swing plate is configured to swingably move between:

a first position at which the developing roller is separated from the photosensitive drum; and a second position at which the developing roller contacts the photosensitive drum or the developing roller is closer to the photosensitive drum than at the first position; and wherein, in a state where the developing cartridge is installed in the apparatus main body and where the swing plate is located at the first position, the swing plate allows the developing cartridge to be guided from the main body guide to the swing plate.

5. The image forming apparatus according to claim 4, where a swing center of the swing plate is located at a lower position than the developing roller in a state where the developing cartridge is installed in the apparatus main body.

6. The image forming apparatus according to claim 5, wherein the developing roller includes a developing shaft extending along a rotational axis of the developing roller;

wherein the developing cartridge includes:

a frame configured to accommodate toner; and a protrusion protruding from the frame and including a part of the developing shaft; and wherein the swing plate includes a first pressing spring configured to, in a state where the developing cartridge is installed in the apparatus main body, press the protrusion upward from below and cause the protrusion to contact the guide.

7. The image forming apparatus according to claim 5, wherein the apparatus main body includes a pressing member configured to move by interlocking with movement of the cover; and wherein the pressing member is configured to move between:

a pressing position at which the pressing member presses the swing plate toward the second position in a state where the cover is located at the closed position; and a pressing release position at which pressing against the swing plate is stopped to cause the swing plate to be located at the first position in a state where the cover is located at the open position.

8. The image forming apparatus according to claim 1, wherein the developing roller includes a developing shaft extending along a rotational axis of the developing roller;

wherein the apparatus main body includes a main body guide configured to guide installation of the developing cartridge into the apparatus main body, the main body guide being configured to guide the developing cartridge toward the swing plate;

wherein the main body guide extends in an installation direction of the developing cartridge, the main body guide having an upstream end and a downstream end in the installation direction of the developing cartridge;

wherein the guide extends in the installation direction of the developing cartridge, the guide having an upstream end and a downstream end in the installation direction of the developing cartridge;

wherein the swing plate is configured to swingably move, about a direction intersecting the installation direction of the developing cartridge, between:

a first position at which the upstream end of the guide is located relative to the downstream end of the main body guide such that the developing shaft is movable from the main body guide to the guide; and a second position at which the upstream end of the guide is shifted, from the first position, relative to the downstream end of the main body guide; and wherein, in a state where the drum cartridge and the developing cartridge are installed in the apparatus main body, the swing plate is located at the second position and causes the developing roller to contact or be adjacent to the photosensitive drum.

9. The image forming apparatus according to claim 8, wherein a swing center of the swing plate is located at a higher position than the developing roller in a state where the developing cartridge is installed in the apparatus main body.

10. The image forming apparatus according to claim 9, wherein the developing cartridge includes:

a frame configured to accommodate toner; and a protrusion protruding from the frame and including a part of the developing shaft; and wherein the swing plate includes a first pressing spring configured to, in a state where the developing cartridge is installed in the apparatus main body, press the protrusion downward from above and cause the protrusion to contact the guide.

11. The image forming apparatus according to claim 10, wherein the apparatus main body includes a second pressing spring located at a lower side of the swing plate, the second pressing spring being configured to press the swing plate in a direction from the second position toward the first position.

12. The image forming apparatus according to claim 11, wherein the apparatus main body includes a third pressing spring located at an opposite side from the second pressing spring with respect to the guide; and wherein the third pressing spring is configured to, in a state where the developing cartridge is installed in the apparatus main body, press the developing cartridge and cause the swing plate to be located at the second position against the second pressing spring.

13. The image forming apparatus according to claim 12, wherein pressing force of the third pressing spring is larger than pressing force of the second pressing spring.

14. The image forming apparatus according to claim 8, wherein the apparatus main body includes a cam configured to move by interlocking with movement of the cover; and wherein the cam is configured to move between:

a pressing position at which, in a state where the cover is located at the open position, the cam presses the swing plate toward the first position; and a pressing release position at which, in a state where the cover is located at the closed position, the cam stops pressing against the swing plate to cause the swing plate to be located at the second position.

15. The image forming apparatus according to claim 14, wherein the apparatus main body includes a contact member configured to move by interlocking with movement of the cover; and wherein the contact member is configured to move between:

a contact position at which the contact member contacts the developing cartridge in a state where the developing cartridge is installed in the apparatus main body and where the cover is located at the closed position; and a noncontact position at which the contact member does not contact the developing cartridge in a state where the developing cartridge is installed in the apparatus main body and where the cover is located at the open position.

16. An image forming apparatus comprising:

an apparatus main body including:

a main casing having an opening; and a cover configured to rotatably move about a rotational axis between an open position at which the opening is opened and a closed position at which the opening is closed;

a drum cartridge including a photosensitive drum and configured to be installed into the apparatus main body through the opening;

a developing cartridge including a developing roller and configured to be installed into the apparatus main body through the opening; and a swing plate attached swingably to the apparatus main body, the swing plate being configured to support the developing cartridge, the swing plate including a guide configured to guide installation of the developing cartridge into the apparatus main body, the swing plate being configured to swingably move in a state where the drum cartridge and the developing cartridge are installed in the apparatus main body, thereby causing the developing roller to move relative to the photosensitive drum, wherein the apparatus main body includes a main body guide configured to guide installation of the developing cartridge into the apparatus main body, the main body guide being configured to guide the developing cartridge toward the swing plate;

wherein, in a state where the developing cartridge is installed in the apparatus main body, the swing plate is configured to swingably move between:

a first position at which the developing roller is separated from the photosensitive drum; and a second position at which the developing roller contacts the photosensitive drum or the developing roller is close to the photosensitive drum than at the first position;

wherein, in a state where the developing cartridge is installed in the apparatus main body and where the swing plate is located at the first position, the swing plate allows the developing cartridge to be guided from the main body guide to the swing plate;

wherein a swing center of the swing plate is located at a lower position than the developing roller in a state where the developing cartridge is installed in the apparatus main body;

wherein the apparatus main body includes a pressing member configured to move by interlocking with movement of the cover; and wherein the pressing member is configured to move between:

a pressing position at which the pressing member presses the swing plate toward the second position in a state where the cover is located at the closed position; and a pressing release position at which pressing against the swing plate is stopped to cause the swing plate to be located at the first position in a state where the cover is located at the open position.

17. An image forming apparatus comprising:

an apparatus main body including:

a main casing having an opening; and a cover configured to rotatably move about a rotational axis between an open position at which the opening is opened and a closed position at which the opening is closed;

a drum cartridge including a photosensitive drum and configured to be installed into the apparatus main body through the opening;

a developing cartridge including a developing roller and configured to be installed into the apparatus main body through the opening; and a swing plate attached swingably to the apparatus main body, the swing plate being configured to support the developing cartridge, the swing plate including a guide configured to guide installation of the developing cartridge into the apparatus main body, the swing plate being configured to swingably move in a state where the drum cartridge and the developing cartridge are installed in the apparatus main body, thereby causing the developing roller to move relative to the photosensitive drum, wherein the developing roller includes a developing shaft extending along a rotational axis of the developing roller;

wherein the apparatus main body includes a main body guide configured to guide installation of the developing cartridge into the apparatus main body, the main body guide being configured to guide the developing cartridge toward the swing plate;

wherein the main body guide extends in an installation direction of the developing cartridge, the main body guide having an upstream end and a downstream end in the installation direction of the developing cartridge;

wherein the guide extends in the installation direction of the developing cartridge, the guide having an upstream end and a downstream end in the installation direction of the developing cartridge;

wherein the swing plate is configured to swingably move, about a direction intersecting the installation direction of the developing cartridge, between:

a first position at which the upstream end of the guide is located relative to the downstream end of the main body guide such that the developing shaft is movable from the main body guide to the guide; and a second position at which the upstream end of the guide is shifted, from the first position, relative to the downstream end of the main body guide;

wherein, in a state where the drum cartridge and the developing cartridge are installed in the apparatus main body, the swing plate is located at the second position and causes the developing roller to contact or be adjacent to the photosensitive drum;

wherein a swing center of the swing plate is located at a higher position than the developing roller in a state where the developing cartridge is installed in the apparatus main body;

wherein the developing cartridge includes:

a frame configured to accommodate toner; and a protrusion protruding from the frame and including a part of the developing shaft;

wherein the swing plate includes a first pressing spring configured to, in a state where the developing cartridge is installed in the apparatus main body, press the protrusion downward from above and cause the protrusion to contact the guide; and wherein the apparatus main body includes a second pressing spring located at a lower side of the swing plate, the second pressing spring being configured to press the swing plate in a direction from the second position toward the first position.

18. An image forming apparatus comprising:

an apparatus main body including:

a main casing having an opening; and a cover configured to rotatably move about a rotational axis between an open position at which the opening is opened and a closed position at which the opening is closed;

a drum cartridge including a photosensitive drum and configured to be installed into the apparatus main body through the opening;

a developing cartridge including a developing roller and configured to be installed into the apparatus main body through the opening; and a swing plate attached swingably to the apparatus main body, the swing plate being configured to support the developing cartridge, the swing plate including a guide configured to guide installation of the developing cartridge into the apparatus main body, the swing plate being configured to swingably move in a state where the drum cartridge and the developing cartridge are installed in the apparatus main body, thereby causing the developing roller to move relative to the photosensitive drum, wherein the developing roller includes a developing shaft extending along a rotational axis of the developing roller;

wherein the apparatus main body includes a main body guide configured to guide installation of the developing cartridge into the apparatus main body, the main body guide being configured to guide the developing cartridge toward the swing plate;

wherein the main body guide extends in an installation direction of the developing cartridge, the main body guide having an upstream end and a downstream end in the installation direction of the developing cartridge;

wherein the guide extends in the installation direction of the developing cartridge, the guide having an upstream end and a downstream end in the installation direction of the developing cartridge;

wherein the swing plate is configured to swingably move, about a direction intersecting the installation direction of the developing cartridge, between:

a first position at which the upstream end of the guide is located relative to the downstream end of the main body guide such that the developing shaft is movable from the main body guide to the guide; and a second position at which the upstream end of the guide is shifted, from the first position, relative to the downstream end of the main body guide;

wherein, in a state where the drum cartridge and the developing cartridge are installed in the apparatus main body, the swing plate is located at the second position and causes the developing roller to contact or be adjacent to the photosensitive drum;

wherein the apparatus main body includes a cam configured to move by interlocking with movement of the cover; and wherein the cam is configured to move between:

a pressing position at which, in a state where the cover is located at the open position, the cam presses the swing plate toward the first position; and a pressing release position at which, in a state where the cover is located at the closed position, the cam stops pressing against the swing plate to cause the swing plate to be located at the second position.

* * * * *